US010293634B2

(12) United States Patent
Sowder

(10) Patent No.: US 10,293,634 B2
(45) Date of Patent: May 21, 2019

(54) FOLDABLE CANVAS BLANK

(71) Applicant: Pratt Corrugated Holdings, Inc., Conyers, GA (US)

(72) Inventor: Reed Sowder, Auburn, AL (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 342 days.

(21) Appl. No.: 15/239,514

(22) Filed: Aug. 17, 2016

(65) Prior Publication Data

US 2018/0050558 A1 Feb. 22, 2018

(51) Int. Cl.
*B44D 3/18* (2006.01)

(52) U.S. Cl.
CPC ..... *B44D 3/18* (2013.01)

(58) Field of Classification Search
CPC ..... B44D 3/18
See application file for complete search history.

(56) References Cited

U.S. PATENT DOCUMENTS

| | | | |
|---|---|---|---|
| 368,236 | A | 8/1887 | Rawbone |
| 773,177 | A | 10/1904 | Wilson |
| 809,785 | A | 1/1906 | Dahlberg |
| 1,077,622 | A | 11/1913 | McLellan |
| 1,086,690 | A | 2/1914 | Rosenberg |
| 1,132,629 | A | 3/1915 | Springman |
| 1,134,802 | A | 4/1915 | Agar |
| 1,435,658 | A | 11/1922 | Prehn |
| 1,476,216 | A | 12/1923 | Palais |
| 1,976,421 | A | 10/1934 | Traeger et al. |
| 2,101,327 | A | 12/1937 | Ziemmerman |
| 2,294,641 | A | 9/1942 | Walters |
| 2,322,259 | A | 6/1943 | Thurston |
| 2,324,027 | A | 7/1943 | Rosenberg et al. |
| 2,474,659 | A | 6/1949 | Ebert |
| 2,630,641 | A | 3/1953 | Hessdoerfer |
| 2,902,785 | A | 9/1959 | Nichols |
| 2,931,515 | A | 4/1960 | Rubin |
| 2,992,500 | A | 7/1961 | Hayhow |

(Continued)

FOREIGN PATENT DOCUMENTS

| | | |
|---|---|---|
| WO | 2015058504 | 4/2015 |
| WO | 2015071383 | 5/2015 |

OTHER PUBLICATIONS

Conrad, Hannah; Final Office Action for U.S. Appl. No. 15/239,518, filed Aug. 17, 2016, dated May 1, 2017, 16 pgs.

(Continued)

*Primary Examiner* — Adam Krupicka
(74) *Attorney, Agent, or Firm* — Taylor English Duma LLP

(57) ABSTRACT

A foldable canvas blank including a working panel, the working panel including a top end, a bottom end, a right side, and a left side; a top end panel flexibly attached to the top end, the top end panel defining a right top end locking tab and a left top end locking tab; a bottom end panel flexibly attached to the bottom end, the bottom end panel defining a right bottom end locking tab and a left bottom end locking tab; a right side panel flexibly attached to the right side, the right side panel configured to frictionally engage the right top end locking tab and the right bottom end locking tab; and a left side panel flexibly attached to the left side, the left side panel configured to frictionally engage the left top end locking tab and the left bottom end locking tab.

20 Claims, 13 Drawing Sheets

(56) References Cited

U.S. PATENT DOCUMENTS

| | | | |
|---|---|---|---|
| 3,137,088 | A | 6/1964 | Spertus |
| 3,275,281 | A | 9/1966 | Sampson |
| 3,853,220 | A | 12/1974 | Luray |
| D300,285 | S | 3/1989 | Karklins |
| 5,052,462 | A | 10/1991 | Stobart |
| 5,084,993 | A | 2/1992 | Dahlheimer |
| 5,154,392 | A | 10/1992 | Voight |
| 5,277,388 | A | 1/1994 | Denaro |
| 5,301,800 | A | 4/1994 | Kenney |
| 5,351,928 | A | 10/1994 | Cooper et al. |
| 5,653,333 | A | 8/1997 | Webster |
| 5,850,910 | A | 12/1998 | Broyles et al. |
| 5,900,276 | A | 5/1999 | Sooklaris |
| 6,338,215 | B1 | 1/2002 | Vincent |
| 6,347,466 | B1 | 2/2002 | Lackner et al. |
| 6,382,581 | B1 | 5/2002 | Duff |
| 6,450,327 | B1 | 9/2002 | Kikuchi |
| 6,581,895 | B1 | 6/2003 | Pleasant |
| 6,685,026 | B1 | 2/2004 | Hanna |
| 7,000,882 | B2 | 2/2006 | Snuffer |
| D518,240 | S | 3/2006 | Bossomo et al. |
| D524,061 | S | 7/2006 | Bruce |
| 7,367,539 | B2 | 5/2008 | Moss et al. |
| D602,227 | S | 10/2009 | Zeilinger |
| 7,861,995 | B2 | 1/2011 | Liou |
| 7,967,154 | B1 | 6/2011 | Sharon |
| D643,223 | S | 8/2011 | Harding |
| D643,635 | S | 8/2011 | Harding |
| 8,136,678 | B2 | 3/2012 | Moss |
| D674,016 | S | 1/2013 | Letterle |
| D677,935 | S | 3/2013 | Pirayesh et al. |
| 8,540,091 | B2 | 9/2013 | Kristensen |
| 8,863,420 | B2 | 10/2014 | Edmondson et al. |
| 8,925,228 | B2 | 1/2015 | Edmondson et al. |
| D725,946 | S | 4/2015 | Pirayesh et al. |
| 9,174,483 | B2 | 11/2015 | Ridless et al. |
| 9,265,366 | B2 | 2/2016 | Zhou et al. |
| 9,358,830 | B1 | 6/2016 | McLaughlin |
| 9,421,816 | B2 | 8/2016 | Stas |
| 9,457,929 | B2 | 10/2016 | Jenkins |
| 9,687,091 | B2 | 6/2017 | Jhagroo |
| 9,802,440 | B2 | 10/2017 | Lu |
| D819,128 | S | 5/2018 | Sowder |
| 2008/0301989 | A1 | 12/2008 | Britten |
| 2010/0032322 | A1 | 2/2010 | O'Neill |
| 2010/0229439 | A1 | 9/2010 | Elliot |
| 2013/0000169 | A1 | 1/2013 | Ramos-Gonzalez et al. |
| 2013/0270413 | A1 | 10/2013 | Wilber et al. |
| 2014/0314971 | A1 | 10/2014 | Domanski et al. |
| 2014/0318722 | A1 | 10/2014 | Ridless |
| 2014/0363592 | A1 | 12/2014 | Zhou et al. |
| 2016/0143461 | A1 | 5/2016 | Millman et al. |
| 2016/0297236 | A1 | 10/2016 | Edgerton-Ball |
| 2017/0173996 | A1 | 6/2017 | Lu |
| 2017/0290449 | A1 | 10/2017 | Snyder |
| 2017/0311738 | A1 | 11/2017 | Wong |

OTHER PUBLICATIONS

Conrad, Hannah; Non-final Office Action for U.S. Appl. No. 15/239,518, filed Aug. 17, 2016, dated Jun. 9, 2017, 21 pgs.

Conrad, Hannah; Restriction Requirement for U.S. Appl. No. 15/239,360, filed Aug. 17, 2016, dated Jun. 9, 2017, 6 pgs.

Conrad, Hannah; U.S. Patent Application entitled: Foldable Easel Blank, having U.S. Appl. No. 15/239,518, filed Aug. 17, 2016, 33 pgs.

Conrad, Hannah; U.S. Patent Application entitled: Foldable Palette Blank, having U.S. Appl. No. 15/239,360, filed Aug. 17, 2016, 23 pgs.

Sowder, Reed; U.S. Design Application entitled: Canvas Formed From a Blank, having U.S. Appl. No. 29/574,646, filed Aug. 17, 2016, 7 pgs.

Conrad, Hannah; U.S. Design Application entitled: Easel Formed From a Blank, having U.S. Appl. No. 29/574,628, filed Aug. 17, 2016, 7 pgs.

Conrad, Hannah; U.S. Design Application entitled: Palette Formed From a Blank, having U.S. Appl. No. 29/754,647, filed Aug. 17, 2016, 7 pgs.

Sowder, Reed; Corrected Notice of Allowability for U.S. Appl. No. 29/574,646, filed Aug. 17, 2016, dated Apr. 26, 2018, 8 pgs.

Sowder, Reed; Issue Notification for U.S. Appl. No. 29/574,646, filed Aug. 17, 2016, dated May 9, 2018, 1 pg.

Sowder, Reed; Notice of Allowance for U.S. Appl. No. 29/574,646, filed Aug. 17, 2016, dated Mar. 29, 2018, 5 pgs.

Sowder, Reed; Non-Final Office Action for U.S. Appl. No. 29/574,646, filed Aug. 17, 2016, dated Nov. 28, 2017, 29 pgs.

Conrad, Hannah; Applicant-Initiated Interview Summary for U.S. Appl. No. 15/239,518, filed Aug. 17, 2016, dated Jan. 18, 2017, 3 pgs.

Conrad, Hannah; Non-Final Office Action for U.S. Appl. No. 15/239,518, filed Aug. 17, 2016, dated Dec. 21, 2016, 23 pgs.

FOLDABLE CANVAS BLANK

TECHNICAL FIELD

This disclosure relates to art supplies. More specifically, this disclosure relates to canvases used for painting.

BACKGROUND

Painters, artists, and art students frequently use canvases as a medium for painting, drawing, and other forms of artistic expression. Traditional canvases are made of a treated portion of canvas cloth stretched tightly over a wooden stretcher frame. Traditional canvases have the disadvantages of being heavy, expensive, and difficult to store. The canvas cloth can be removed from the wooden frame to allow for convenient storage, but the process and time consuming and deteriorates the canvas and the painted image if it is repeatedly mounted and unmounted from wooden stretcher frames. It would be desirable to have an affordable, lightweight canvas which can easily be flattened for storage without adverse effects.

SUMMARY

Disclosed is a foldable canvas blank including a working panel, the working panel comprising a top end, a bottom end, a right side, and a left side, the top disposed opposite from the bottom, the left side disposed opposite from the right side; a top end panel flexibly attached to the top end by a first top end hinge, the top end panel defining a front surface and a rear surface, the top end panel defining a pair of top end locking slots extending from the front surface to the rear surface, the pair of top end locking slots defining a right top end locking tab and a left top end locking tab; a bottom end panel flexibly attached to the bottom end by a first bottom end hinge, the bottom end panel defining a front surface and a rear surface, the bottom end panel defining a pair of bottom end locking slots extending from the front surface to the rear surface, the pair of bottom end locking slots defining a right bottom end locking tab and a left bottom end locking tab; a right side panel flexibly attached to the right side by a first right side hinge, the right side panel configured to frictionally engage the right top end locking tab and the right bottom end locking tab in a folded position; and a left side panel flexibly attached to the left side by a first left side hinge, the left side panel configured to frictionally engage the left top end locking tab and the left bottom end locking tab in the folded position.

Also disclosed is a folded canvas including a working panel, the working panel defining a front working surface and a rear working surface, the working panel comprising a top end, a bottom end, a right side, and a left side, the top disposed opposite from the bottom, the left side disposed opposite from the right side; a top frame end disposed on the rear working surface at the top end of the working panel, the top frame end defining a pair of top end locking slots, the pair of top end locking slots defining a right top end locking tab and a left top end locking tab; a bottom frame end disposed on the rear working surface at the bottom end of the working panel, the bottom frame end defining a pair of bottom end locking slots, the pair of bottom end locking slots defining a right bottom end locking tab and a left bottom end locking tab; a right frame side disposed on the rear working surface at the right side of the working panel, the right frame side frictionally engaging the right top end locking tab and the left top end locking tab; and a left frame side disposed on the rear working surface at the left side of the working panel, the left frame side frictionally engaging the left top end locking tab and the left bottom end locking tab.

Also disclosed is a method for assembling a folded canvas including obtaining a foldable canvas blank, the foldable canvas blank including: a working panel, the working panel comprising a top end, a bottom end, a right side, and a left side, the top disposed opposite from the bottom, the left side disposed opposite from the right side; a top end panel flexibly attached to the top end, the top end panel defining a pair of top end locking slots, the pair of top end locking slots defining a right top end locking tab and a left top end locking tab; a bottom end panel flexibly attached to the bottom end, the bottom end panel defining a pair of bottom end locking, the pair of bottom end locking slots defining a right bottom end locking tab and a left bottom end locking tab; a right side panel flexibly attached to the right side; and a left side panel flexibly attached to the left side; folding the top end panel and the bottom end panel into an assembled end shape; folding the right side panel and the left side panel into an assembled side shape; frictionally engaging the right side panel with the right top end locking tab and the right bottom end locking tab; and frictionally engaging the left side panel with the left top end locking tab and the left bottom end locking tab.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
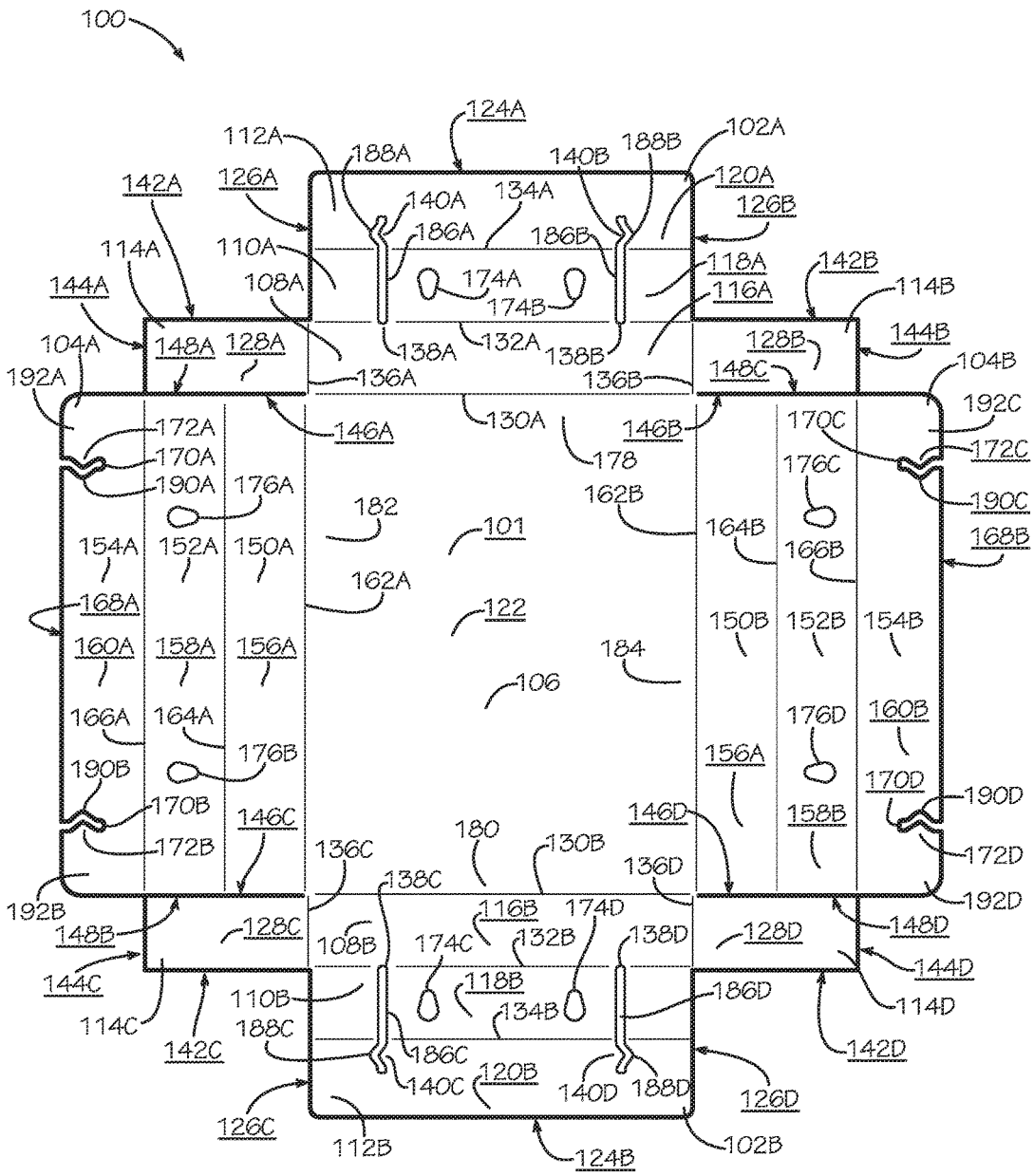
FIG. 1 is a top plan view of a foldable canvas blank according to an embodiment of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in their best, currently known embodiments. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can comprise two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or Steps are included or are to be performed in any particular embodiment.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

Disclosed is a foldable canvas blank and associated methods, systems, devices, and various apparatus. In various embodiments, the foldable canvas blank comprises a working panel, a top end panel, a bottom end panel, a right side panel, and a left side panel. It would be understood by one of skill in the art that the disclosed foldable canvas blank is described in but a few exemplary embodiments among many. No particular terminology or description should be considered on the disclosure or the scope of any claims issuing therefrom.

A top plan view of one embodiment of a foldable canvas blank 100 is shown in FIG. 1.

The foldable canvas blank 100 is configured to fold into a folded canvas 500 (shown in FIGS. 5-13). FIG. 1 shows a blank rear surface 101 defined by the foldable canvas blank 100. The blank rear surface 101 is substantially planar. The foldable canvas blank 100 comprises a working panel 106 with a rear working surface 122 and a front working surface 622 (shown in FIG. 6) opposite from the rear working surface 122.

The working panel 106 can define a substantially rectangular shape; however the shape of the working panel 106 should not be viewed as limiting. In some embodiments, the rectangular shape can be a square. The working panel 106 comprises a top end 178, a bottom end 180, a right side 182, and a left side 184. The top end 178 is disposed opposite from the bottom end 180, and the left side 184 is disposed opposite from the right side 184. In some embodiments, the top end 178 and the bottom end 180 can be shorter in length than the right side 182 and the left side 184. In other embodiments, the top end 178 and the bottom end 180 can be longer in length than the right side 182 and the left side 184. In other embodiments, the top end 178, bottom end 180, right side 182, and left side 184 can be equal in length. The proportions of the top end 178, bottom end 180, right side 182, and left side 184 relative to one another should not be viewed as limiting.

The foldable canvas blank 100 comprises a top end panel 102A and a bottom end panel 102B (hereafter generally referred to as "end panels 102"). The top end panel 102A can be flexibly attached to the top end 178 of the working panel 106 by a first top end hinge 130A, and the bottom end panel 102B can be flexibly attached to the bottom end 180 of the working panel 106 by a first bottom end hinge 130B (hereafter generally referred to as "first end hinges 130"). The first end hinges 130 allow the end panels 102 to fold relative to the working panel 106.

Figure 8:
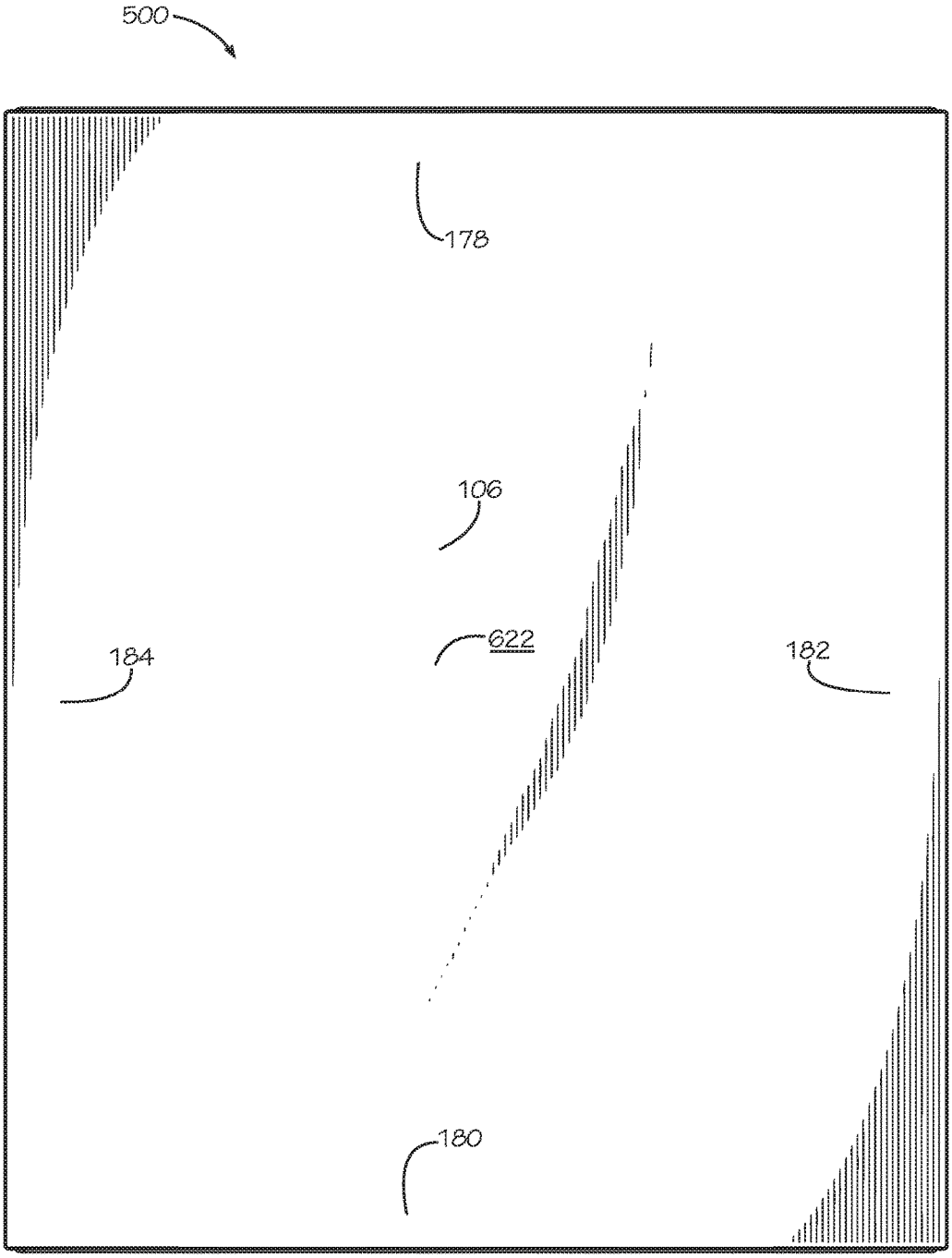
FIG. 8 is a front view of the folded canvas of FIG. 5.

As shown in FIG. 1, the top end panel 102A comprises a first top end subpanel 108A, a second top end subpanel 110A, a third top end subpanel 112A, a top right wing 114A, and a top left wing 114A. The terms "left" and "right" are used relative to a front view (as shown in FIG. 8) of the foldable canvas blank 100 assembled into the folded canvas 500 in a portrait orientation. The orientation should not be considered limiting as the folded canvas 500 can also be used, hung, or displayed in a landscape orientation. The first top end subpanel 108A is positioned adjacent to the top end 178 of the working panel 106 and is flexibly attached by the first top end hinge 130A. The second top end subpanel 110A is flexibly attached to the first top end subpanel 108A by a second top end hinge 132A positioned opposite from the first top end hinge 130A. The third top end subpanel 112A is flexibly attached to the second top end subpanel 110A by a third top end hinge 134A positioned opposite from the second top end hinge 132A. The first top end subpanel 108A is positioned adjacent to the working panel 106, the third top end subpanel 112A is positioned distal from the working panel 106, and the second top end subpanel 110A is positioned between the first top end subpanel 108A and the third top end subpanel 112A. The top right wing 114A is flexibly attached to a right side of the first top end subpanel 108A by a top right hinge 136A. The top left wing 114B is flexibly attached to a left side of the first top end subpanel 108A by a top left hinge 136B.

The top end panel 102A defines a top end edge surface 124A distal from the working panel, a top right edge surface 126A, and a top left edge surface 126B. The top right wing 114A defines a first edge surface 142A, a second edge surface 144A, and a third edge surface 146A. The top left wing 114B defines a first edge surface 142B, a second edge surface 144B, and a third edge surface 146B. The first top end subpanel 108A defines a rear surface 116A and a front surface 616A (shown in FIG. 6) opposite from the rear surface 116A. The second top end subpanel 110A defines a rear surface 118A and a front surface 318A (shown in FIG. 3) opposite from the rear surface 118A. The third top end subpanel 112A defines a rear surface 120A and a front surface 320A (shown in FIG. 3) opposite from the rear surface 120A. The top right wing 114A defines a rear surface 128A and a front surface (not shown) opposite from the rear surface 128A. The top left wing 114B defines a rear surface 128B and a front surface (not shown) opposite from the rear surface 128B.

As shown in FIG. 1, the bottom end panel 102B comprises a first bottom end subpanel 108B, a second bottom end subpanel 110B, a third bottom end subpanel 112B, a bottom right wing 114C, and a bottom left wing 114D. The first bottom end subpanel 108B is positioned adjacent to the bottom end 180 of the working panel 106 and is flexibly attached by the first bottom end hinge 130B. The second bottom end subpanel 110B is flexibly attached to the first bottom end subpanel 108B by a second bottom end hinge 132B positioned opposite from the first bottom end hinge 130B. The third bottom end subpanel 112B is flexibly attached to the second bottom end subpanel 110B by a third bottom end hinge 134B positioned opposite from the second bottom end hinge 132B. The first bottom end subpanel 108B is positioned adjacent to the working panel 106, the third bottom end subpanel 112B is positioned distal from the working panel 106, and the second bottom end subpanel 110B is positioned between the first bottom end subpanel 108B and the third bottom end subpanel 112B. The bottom right wing 114C is flexibly attached to a right side of the first bottom end subpanel 108B by a bottom right hinge 136C. The bottom left wing 114D is flexibly attached to a left side of the first bottom end subpanel 108B by a bottom left hinge 136D.

The bottom end panel 102B defines a bottom end edge surface 124B distal from the working panel 106, a bottom right edge surface 126C, and a bottom left edge surface 126D. The bottom right wing 114C defines a first edge surface 142C, a second edge surface 144C, and a third edge surface 146C. The bottom left wing 114D defines a first edge surface 142D, a second edge surface 144D, and a third edge surface 146D. The first bottom end subpanel 108B defines a rear surface 116B and a front surface 316B (shown in FIG. 3) opposite from the rear surface 116A. The second bottom end subpanel 110B defines a rear surface 118B and a front surface 318B (shown in FIG. 3) opposite from the rear surface 118B. The third bottom end subpanel 112B defines a rear surface 120B and a front surface 720B (shown in FIG. 7) opposite from the rear surface 120B. The bottom right wing 114C defines a rear surface 128C and a front surface (not shown) opposite from the rear surface 128C. The bottom left wing 114D defines a rear surface 128D and a front surface (not shown) opposite from the rear surface 128B.

The foldable canvas blank 100 can further comprise a right side panel 104A and a left side panel 104B (hereafter generally referred to as "side panels 104"). The terms "left" and "right" are used relative to the front view (as shown in FIG. 8) of the foldable canvas blank 100 as formed into the folded canvas 500. The right side panel 104A and the left side panel 104B are attached at opposite sides of the working panel 106. The right side panel 104A can be flexibly attached to the right side 182 of the working panel 106 by a first right side hinge 162A, and the left side panel 104B can be flexibly attached to the left side 184 of the working panel 106 by a first left side hinge 162B (hereafter generally referred to as "first side hinges 162"). The first side hinges 162 allow the side panels 104 to fold relative to the working panel 106.

As shown in FIG. 1, the right side panel 104A comprises a first right side subpanel 150A, a second right side subpanel 152A, and a third right side subpanel 154A. The first right side subpanel 150A is positioned adjacent to the right side 182 of the working panel 106 and is flexibly attached by the first right side hinge 162A. The second right side subpanel 152A is flexibly attached to the first right side subpanel 150A by a second right side hinge 164A positioned opposite from the first right side hinge 162A. The third right side subpanel 154A is flexibly attached to the second right side subpanel 152A by a third right side hinge 166A positioned opposite from the second right side hinge 164A. The first right side subpanel 150A is positioned adjacent to the working panel 106, the third right side subpanel 154A is positioned distal from the working panel 106, and the second right side subpanel 152A is positioned between the first right side subpanel 150A and the third right side subpanel 154A.

The right side panel 104A defines a right side edge surface 168A distal from the working panel 106, a top right side surface 148A, and a bottom right side surface 148B. In the unfolded position shown in FIG. 1, the third edge surface 146A of the top right wing 144A lies flat against the top right side surface 148A, and the third edge surface 146C of the bottom right wing 144C lies flat against the bottom right side surface 148B. The first right side subpanel 150A defines a rear surface 156A and a front surface 756A (shown in FIG. 7) opposite from the rear surface 156A. The second right side subpanel 152A defines a rear surface 158A and a front surface 458A (shown in FIG. 4) opposite from the rear surface 158A. The third right side subpanel 154A defines a rear surface 160A and a front surface 460A (shown in FIG. 4) opposite from the rear surface 160A.

As shown in FIG. 1, the left side panel 104B comprises a first left side subpanel 150B, a second left side subpanel 152B, and a third left side subpanel 154B. The first left side subpanel 150B is positioned adjacent to the left side 184 of the working panel 106 and is flexibly attached by the first left side hinge 162B. The second left side subpanel 152B is flexibly attached to the first left side subpanel 150B by a second left side hinge 164B positioned opposite from the first left side hinge 162B. The third left side subpanel 154B is flexibly attached to the second left side subpanel 152B by a third left side hinge 166B positioned opposite from the second left side hinge 164B. The first left side subpanel 150B is positioned adjacent to the working panel 106, the third left side subpanel 154B is positioned distal from the working panel 106, and the second left side subpanel 152B is positioned between the first left side subpanel 150B and the third left side subpanel 154B.

The left side panel 104B defines a left side edge surface 168B distal from the working panel 106, a top left side surface 148C, and a bottom left side surface 148D. In the unfolded position shown in FIG. 1, the third edge surface 146B of the top left wing 144B lies flat against the top left side surface 148C, and the third edge surface 146D of the bottom left wing 144D lies flat against the bottom left side surface 148D. The first left side subpanel 150B defines a rear surface 156B and a front surface 656B (shown in FIG. 6) opposite from the rear surface 156B. The second left side subpanel 152B defines a rear surface 158B and a front surface 458B (shown in FIG. 4) opposite from the rear surface 158B. The third left side subpanel 154B defines a rear surface 160B and a front surface 460B (shown in FIG. 4) opposite from the rear surface 160A.

Figure 3:
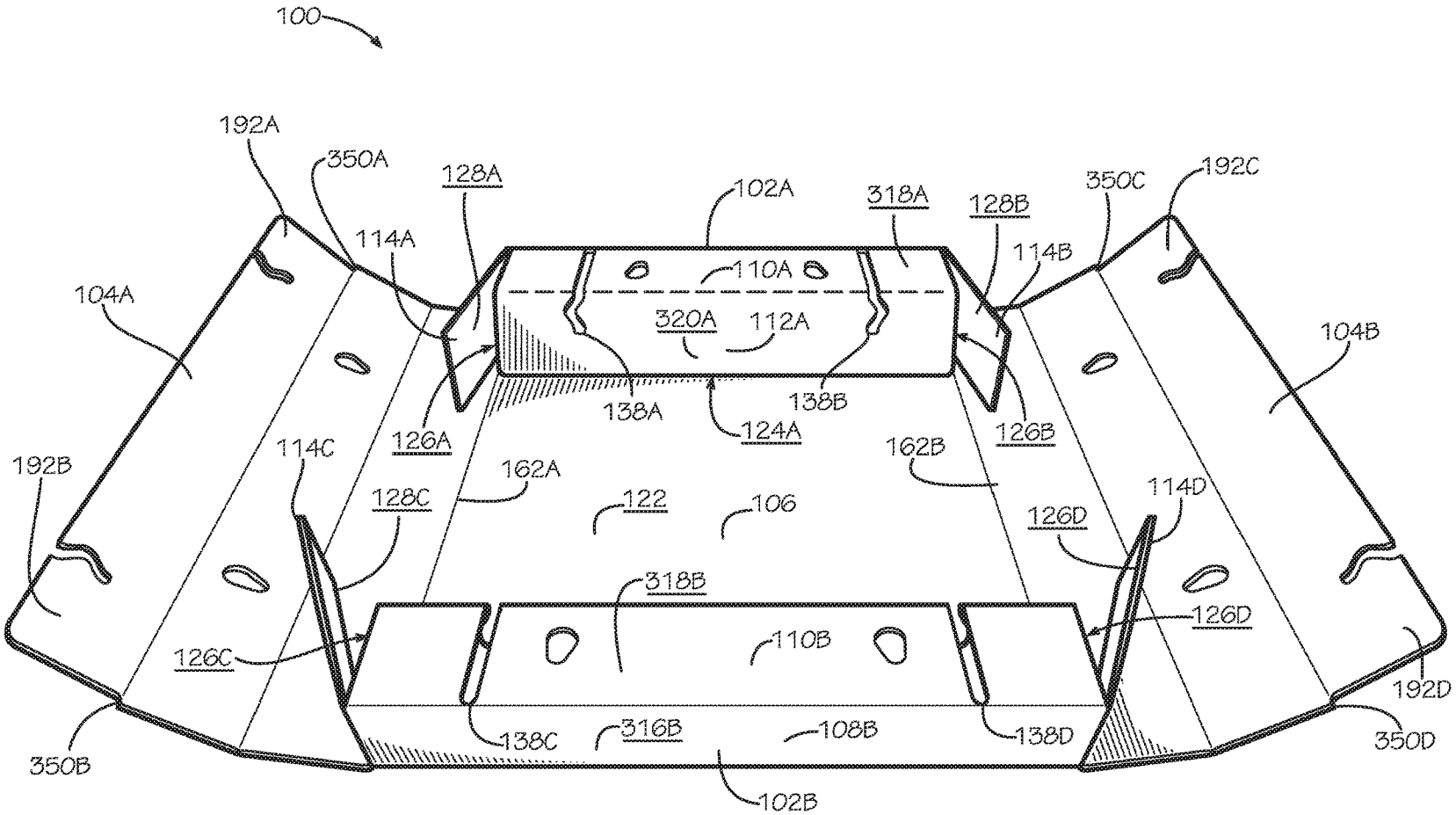
FIG. 3 is a rear perspective view of the foldable canvas blank of FIG. 1 with each of the top end panel and a bottom end panel folded into an assembled end position.

The second top end subpanel 110A defines a pair of end holes 174A,B extending from the rear surface 118A to the front surface 318A (shown in FIG. 3). The second bottom end subpanel 110B defines a pair of end holes 174C,D extending from the rear surface 118B to the front surface 318B (shown in FIG. 3; hereafter 174A,B,C,D generally referred to as "end holes 174"). The second right side panel 152A defines a pair of side holes 176A,B extending from the rear surface 158A to the front surface 458A (shown in FIG. 4). The second left side panel 152B defines a pair of side holes 176C,D extending from the rear surface 158B to the front surface 458B (shown in FIG. 4; hereafter, 176A,B,C,D generally referred to as "side holes 176"). As shown in FIG. 1, the end holes 174 and the side holes 176 have an egg shape wherein the end holes 174 and the side holes 176 are narrower proximate the working panel 106 and wider distal from the working panel 106. The shape, size, and number of end holes 174 and side holes 176 should not be viewed as limiting, however. The end holes 174 and 176 can have other shapes such as a keyhole, circle, oval, triangle, rectangle, or any other shape.

The right side panel 104A defines a pair of right side locking slots 170A,B. Specifically, the third right side subpanel 154A of the right side panel 104A defines the pair of right side locking slots 170A and 170B, each extending from the rear surface 160A to the front surface 460A (shown in FIG. 4). The left side panel 104B defines a pair of left side locking slots 170C,D. Specifically, the third left side subpanel 154B of the left side panel 104B defines the pair of left side locking slots 170C and 170D, each extending from the rear surface 160B to the front surface 460B (shown in FIG. 4). The right side locking slots 170A,B are disposed distal from the working panel 106 and intersect the right side edge surface 168A. The left side locking slots 170C,D are disposed distal from the working panel 106 and intersect the left side edge surface 168B.

Each of the side locking slots 170A,B,C,D (hereafter generally referred to as "side locking slots 170") comprises a curved portion 190A,B,C,D (hereafter generally referred to as "curved portions 190"). The curved portions 190 each respectively define a side locking tab 172A,B,C,D. Side locking tab 172A is a top right side locking tab. Side locking tab 172B is a bottom right side locking tab. Side locking tab 172C is a top left side locking tab. Side locking tab 172D is a bottom left side locking tab. When the foldable canvas blank 100 is in a folded position, the top end panel 102A is configured to frictionally engage the top right side locking tab 172A and the top left side locking tab 172C. The bottom end panel 102B is configured to frictionally engage the bottom right side locking tab 172B and the bottom left side locking tab 172D in the folded position. The shape of the side locking slots 170 and the curved portions 190 should not be viewed as limiting. In some embodiments, the curved portions 190 can be semi-circular, but in other embodiments, the curved portions 190 can be rectangular, triangular, V-shaped, C-shaped, or any other shape.

The right side panel 104A defines a pair of insertion tabs 192A,B, and the left side panel 104B defines a pair of insertions tabs 192C,D. A portion of the third right subpanel 154A between the side slot 170A and the top right side surface 148A defines the insertion tab 192A. A portion of the third right subpanel 154A between the side slot 170B and the bottom right side surface 148B defines the insertion tab 192B. A portion of the third left subpanel 154B between the side slot 170C and the top left side surface 148C defines the insertion tab 192C. A portion of the third left subpanel 154B between the side slot 170D and the bottom left side surface 148D defines the insertion tab 192D (the insertion tabs 192A,B,C,D hereafter generally referred to as "insertion tabs 192"). In the embodiment shown, each insertion tab 192A,B,C,D respectively comprises a clearance notch 350A,B,C,D (shown in FIG. 3) configured to provide clearance between each insertion tab 192 and each respective end locking slot 138.

The top end panel 102A defines a pair of top end locking slots 138A,B. Specifically, the second top end subpanel 110A and the third top end subpanel 112A of the top end panel 102A together define the pair of top end locking slots 138A and 138B. The bottom end panel 102B defines a pair of bottom end locking slots 138C,D. Specifically, the second bottom end subpanel 110B and the third bottom end subpanel 112B of the bottom end panel 102B together define the pair of bottom end locking slots 138C and 138D. Each of the end locking slots 138A,B,C,D (hereafter generally referred to as "end locking slots 138") comprises a straight portion 186A,B,C,D (hereafter generally referred to as "straight portions 186") and a curved portion 188A,B,C,D (hereafter generally referred to as "curved portions 188"). The curved portions 188A,B,C,D each respectively define an end locking tab 140A,B,C,D. The end locking tab 140A is a right top end locking tab. The end locking tab 140B is a left top end locking tab. The end locking tab 140C is a right bottom end locking tab. The end locking tab 140D is a left bottom end locking tab. The right side panel 104A is configured to frictionally engage the right top end locking tab 140A and the right bottom end locking tab 140C in the folded position. The left side panel 104B is configured to frictionally engage the left top end locking tab 140C and the left bottom end locking tab 140D in the folded position. The shape of the end locking slots 138A,B,C,D and the curved portions 188 should not be viewed as limiting. In some embodiments, the curved portions 188 can be semi-circular, but in other embodiments, the curved portions 188 can be rectangular, triangular, V-shaped, C-shaped, or any other shape.

The orientation of the curved portions 188,190 determines which surfaces the locking tabs 140,172 engage. For example in the embodiment shown, the end locking tabs 140 are configured to engage the front surfaces 460A,B of the side panels 104A,B, respectively. By mirroring the shape of the curved portions 188, the end locking tabs 140 can be configured to engage the rear surfaces 160A,B of the side panels 104A,B. The orientation and number of the curved portions 188,190 and locking tabs 140,172 should not be viewed as limiting. Each locking slot 138,170 can comprise more than one curved portion 188,190 and locking tab 140,172, respectively.

The straight portions 186A,B are defined by the second top end subpanel 110A and extend from the rear surface 118A to the front surface 318A (shown in FIG. 3). The curved portions 188A,B are defined by the third top end subpanel 112A and extend from the rear surface 120A to the front surface 320A (shown in FIG. 3). The straight portions 186C,D are defined by the second bottom end subpanel 110B and extend from the rear surface 118B to the front surface 318B (shown in FIG. 3). The curved portions 188C,D are defined by the third bottom end subpanel 112B and extend from the rear surface 120B to the front surface 720B (shown in FIG. 7).

Figure 2:
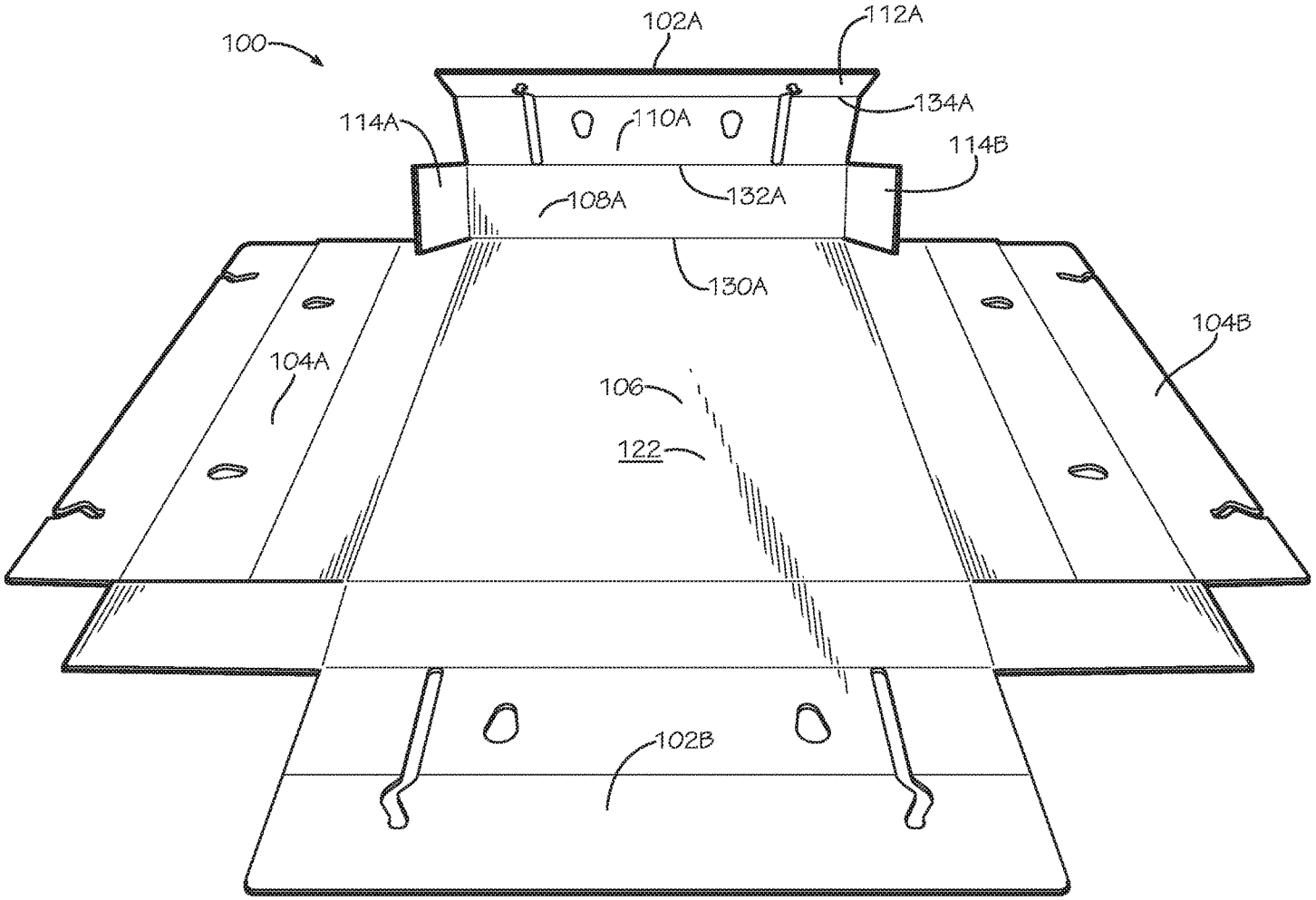
FIG. 2 is a rear perspective view of the foldable canvas blank of FIG. 1 with a top end panel partially folded.

As previously described, the foldable canvas blank 100 is configured to fold into a folded canvas 500 (shown in FIGS. 5-13). FIGS. 2-5 illustrate the method through which the foldable canvas blank 100 is folded into the folded position to form the folded canvas 500. All or any one of the hinges 130A,B, 132A,B, 134A,B, 136A-D, 162A,B, 164A,B, 166A,B can be scored, perforated, creased, or otherwise weakened to bias each to fold towards the blank rear surface 101. FIG. 2 shows the foldable canvas blank 100 with the top end panel 102A partially folded. As shown, the top end panel 102A is partially folded along the first top end hinge 130A, the second top end hinge 132A, and the third top end hinge 134A allowing the first top end subpanel 108A, the second top end subpanel 110A, and the third top end subpanel 112A to articulate relative to one another. Additionally the top right wing 114A and the top left wing 114B are shown partially folded along inwards towards the working panel 106 along the top right hinge 136A and the top left hinge 136B, respectively.

FIG. 3 shows the top end panel 102A and the bottom end panel 102B folded into an assembled end shape. In the assembled end shape, the first top end subpanel 108A (not shown), the third top end subpanel 112A, the first bottom end subpanel 108B, the third bottom end subpanel 112B (not shown), the top right wing 114A, the top left wing 114B, the bottom left wing 114C, and the bottom right wing 114D are positioned substantially perpendicular to the rear working surface 122 of the working panel 106. The first top end hinge 130A, the second top end hinge 132A, the second top end hinge 134A, the first bottom end hinge 130B, the second bottom end hinge 132B, the third bottom end hinge 134B, the top right hinge 136A, the top left hinge 136B, the bottom right hinge 136C, and the bottom left hinge 136D are all folded to form substantially 90° angles between the adjacent panels each joins. The top end edge surface 124A and the bottom end edge surface 124B (shown in FIG. 1) are positioned adjacent to the rear working surface 122 of the working panel 106. The top right edge surface 126A is positioned adjacent to the rear surface 128A of the top right wing 114A. The top left edge surface 126B is positioned adjacent to the rear surface 128B of the top left wing 114B. The bottom right edge surface 126C is positioned adjacent to the rear surface 128C of the bottom right wing 114C. The bottom left edge surface 126D is positioned adjacent to the rear surface 128D of the bottom left wing 114D. The front surfaces 318A and 318B of the second top end subpanel 110A and the second bottom end subpanel 110B, respectively, are substantially parallel to the rear working surface 122 of the working panel 106. In the assembled end shape, the end locking slots 138 are configured to receive a different one of the insertion tabs 192 of the right side panel 104A and the left side panel 104B.

Figure 4:
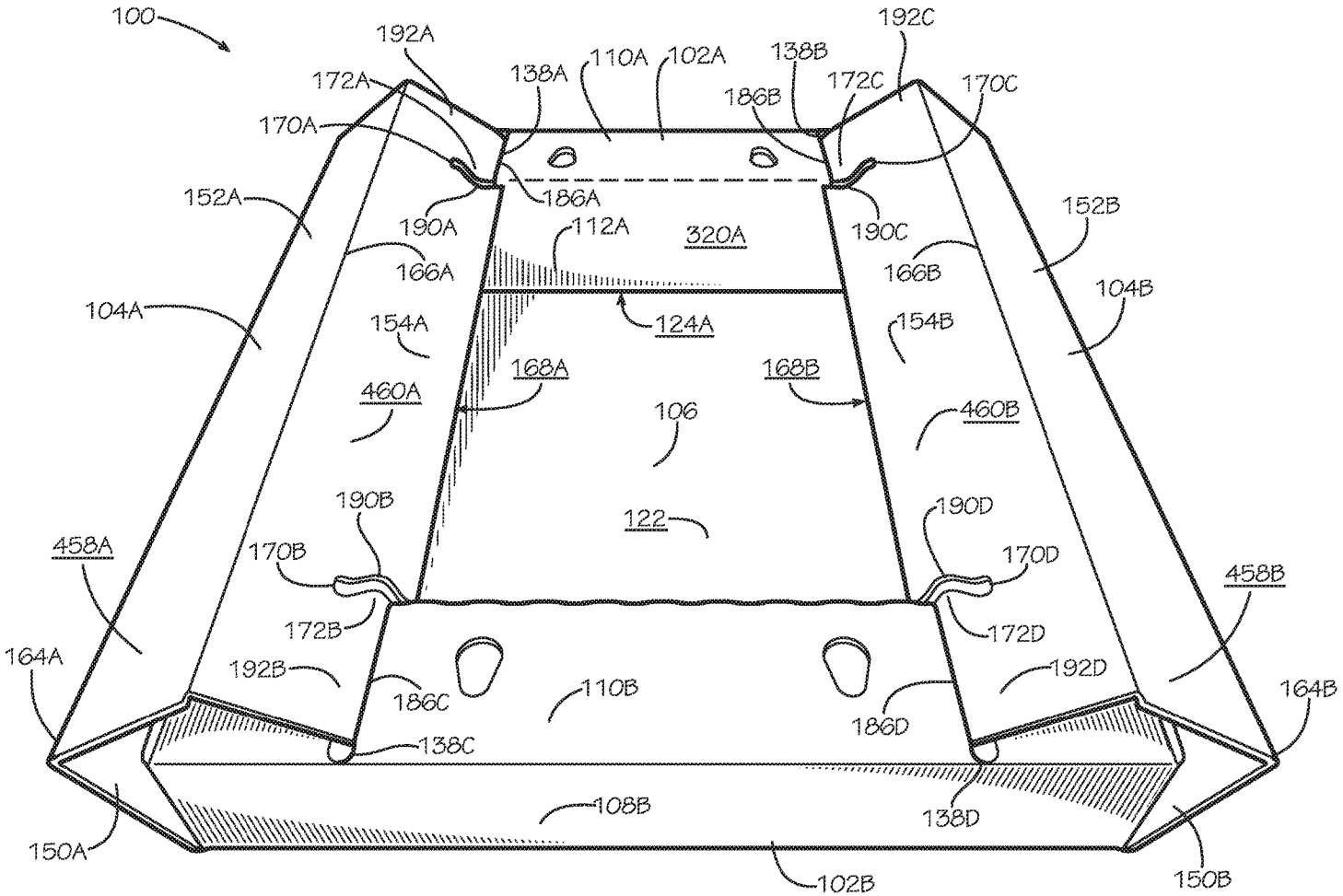
FIG. 4 is a rear perspective view of the foldable canvas blank of FIG. 1 with the top end panel and the bottom end panel in the assembled end position and a left side panel and a right side panel partially folded.
Figure 5:
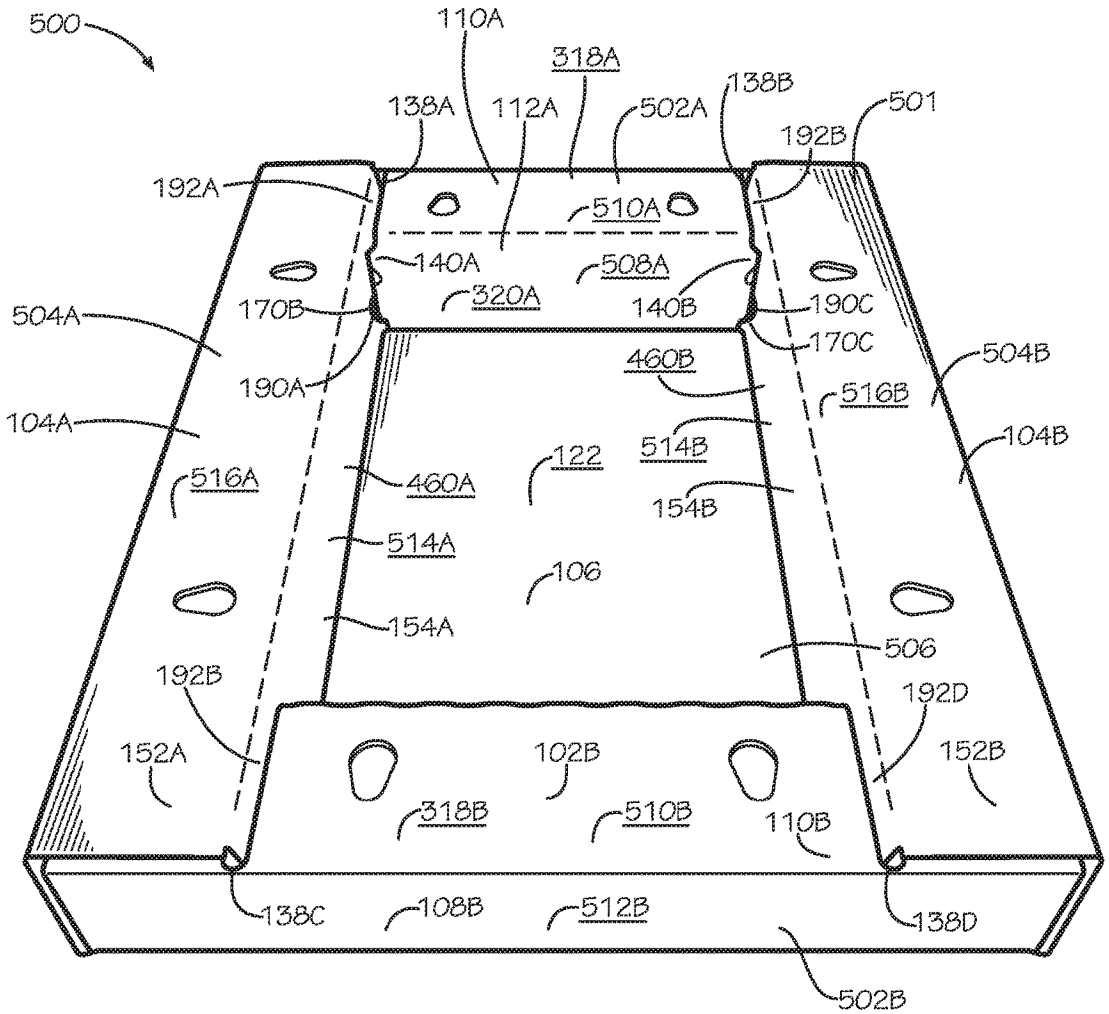
FIG. 5 a perspective view of a rear of a folded canvas assembled from the foldable canvas blank of FIG. 1.

FIG. 4 shows the foldable canvas blank 100 with the top end panel 102A and the bottom end panel 102B in the assembled end position, and the right side panel 104A and left side panel 104B partially folded inwards. In this position, the insertion tabs 192 are beginning to engage the straight portions 186 of the end locking slots 138. As the insertion tabs 192 are inserted deeper into the end locking slots 138, the curved portions 188 (shown in FIG. 1) of the end panels 102 begin to engage the curved portions 190 of the side panels 104. Once the insertion tabs 192 have been fully inserted into the end locking slots 138 as shown in FIG. 5, the end locking tabs 140 of the end panels 102 engage the front surfaces 460A,B of the third right side subpanel 154A and the third left side subpanel 154B, respectively. Upon full insertion of the insertion tabs 192, the side locking tabs 172 of the side panels 104 also engage the rear surfaces 120A and 120B of the third top end subpanel 112A and the third bottom end subpanel 112B, respectively.

As a representative example, the end locking tab 140A engages a portion of the third right side subpanel 154A positioned between the side cutout 170A and the third right side hinge 166A as demonstrated in FIG. 5. The end locking tab 140A presses against the front surface 460A of the third right side subpanel 154A, thereby frictionally engaging the right side panel 104A and locking it in an assembled side shape as shown in FIG. 5. FIG. 5 shows the end locking tab 140A pressing against the front surface 460A, and end locking tab 140B pressing against the front surface 460B. In the assembled side shape, the side locking tab 172A engages a portion of the third top end subpanel 112A positioned between the end locking slot 138A and the top end edge surface 124A. The side locking tab 172A presses against the rear surface 120A of the third top end subpanel 112A, thereby frictionally engaging the top end panel 102A and locking the right side panel 104A into the assembled side shape while also locking the top end panel 102A in the assembled end shape.

FIG. 5 shows a perspective view of the rear of the folded canvas 500 assembled from the foldable canvas blank 100. The foldable canvas blank 100 in the folded position forms the folded canvas 500. As shown in FIG. 5, the folded canvas 500 comprises a pair of frame ends 502: a top frame end 502A formed by the top end panel 102A and a bottom frame end 502B formed by the bottom end panel 102B. The folded canvas 500 also comprises a pair of frame sides 504: a right frame side 504A formed by the right side panel 104A and a left frame side 504B formed by the left side panel 104B. The frame ends 502 and frame sides 504 each have a substantially rectangular cross-section; however the shape of the cross-section should not be considered limiting and can be any other shape such as square. The frame ends 502 and frame sides 504 comprise a canvas frame 501. The frame ends 502 and frame sides 504 are disposed on the rear working surface 122 of the working panel 106. The top frame end 502A is disposed at the top end 178 of the working panel 106. The bottom frame end 502B is disposed at the bottom end 180 of the working panel 106. The right frame side 504A is disposed at the right side 182 of the working panel 106. The left frame side 504*b* is disposed at the left side 184 of the working panel 106.

Figure 6:
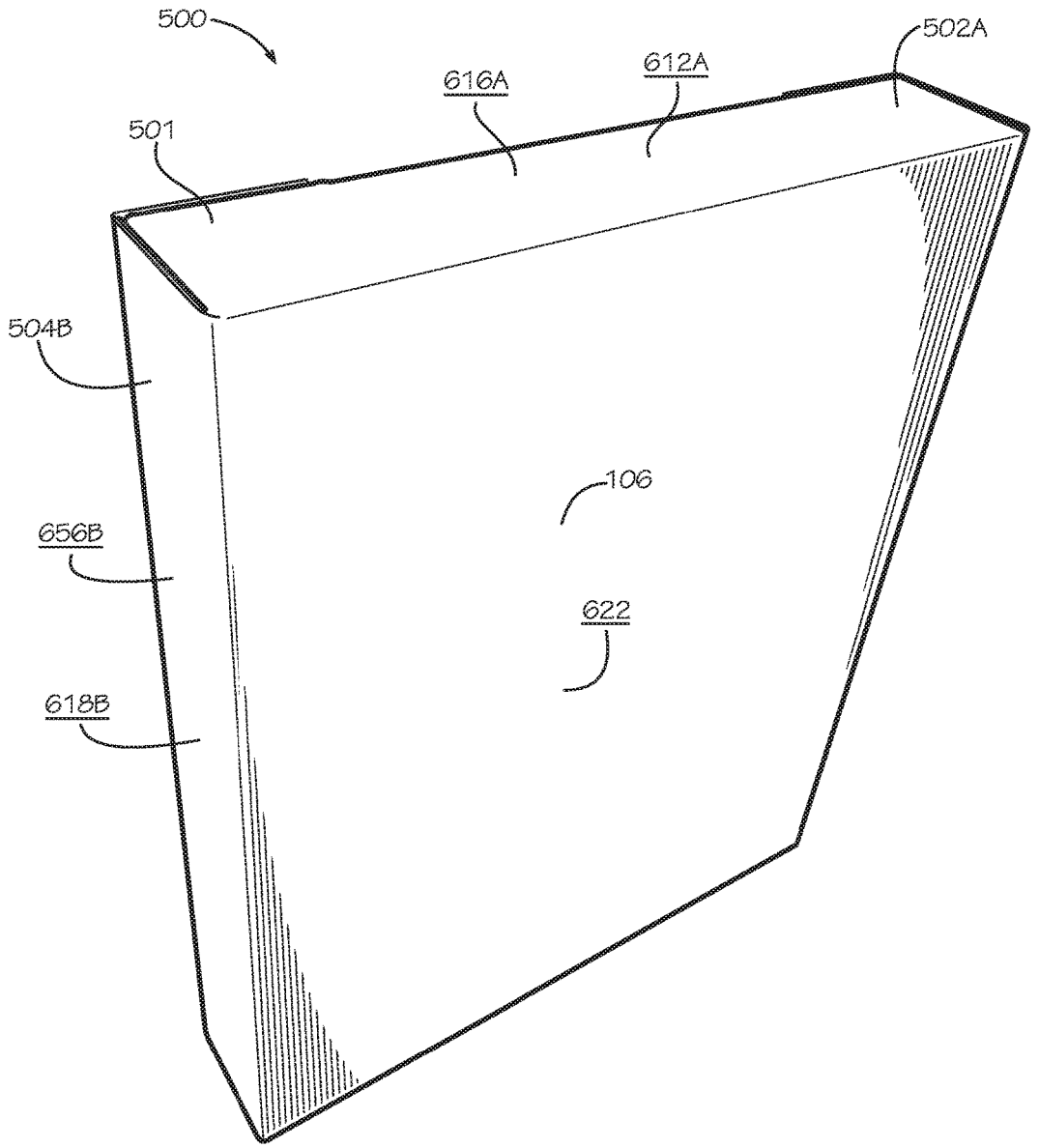
FIG. 6 is a front top perspective view of the folded canvas of FIG. 5 showing a top, a left side, and a front of the folded canvas.

The top frame end 502A defines an inner top frame surface 508A, a rear top frame surface 510A, and an outer top frame surface 612A (shown in FIG. 6). The inner top frame surface 508A is defined by a portion of the front surface 320A of the third top end subpanel 112A positioned between the third right side subpanel 154A and the third left side subpanel 154B. The rear top frame surface 510A is defined by a portion of the front surface 318A of the second top end subpanel 110A positioned between the third right side subpanel 154A and the third left side subpanel 154B. The outer top frame surface 612A is defined by the front surface 616A of the first top end subpanel 108A (shown in FIG. 6).

The bottom frame end 502B defines an inner bottom frame surface 708B (shown in FIG. 7), a rear bottom frame surface 510B, and an outer bottom frame surface 512B. The inner bottom frame surface 708B is defined by a portion of the front surface 720B of the third bottom end subpanel 112B positioned between the third right side subpanel 154A and the third left side subpanel 154B. The rear bottom frame surface 510B is defined by a portion of the front surface 318B of the second bottom end subpanel 110B positioned between the third right side subpanel 154A and the third left side subpanel 154B. The outer top frame surface 512B is defined by the front surface 316B of the first bottom end subpanel 108B.

Figure 7:
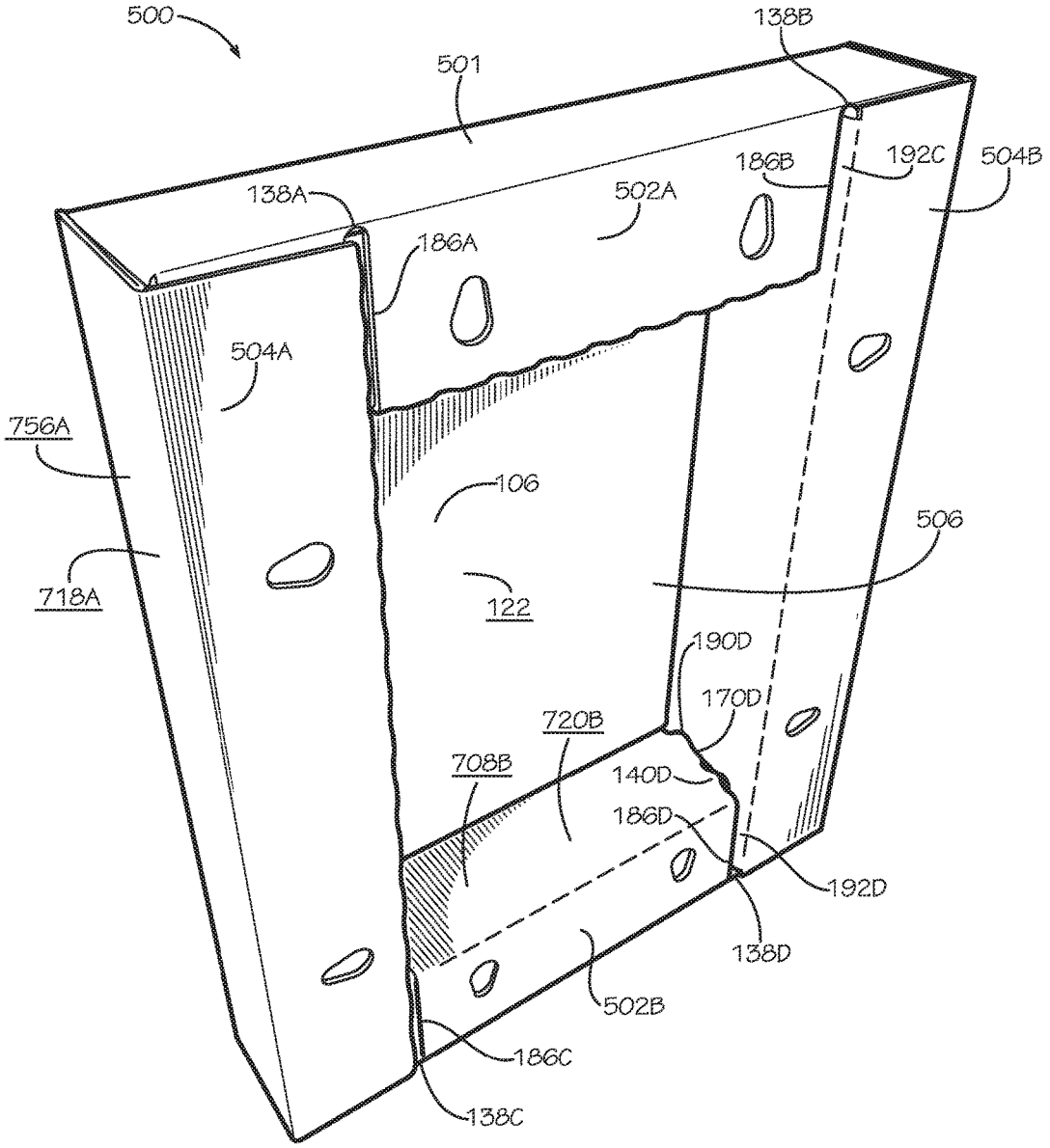
FIG. 7 is a rear top perspective view of the folded canvas of FIG. 5 showing a top, a right side, and the rear of the folded canvas.

The right frame side 504A defines an inner right frame surface 514A, a rear right frame surface 516A, and an outer right frame surface 718A (shown in FIG. 7). The inner right frame surface 514A is defined by a portion of the front surface 460A of the third right side subpanel 154A positioned substantially between the third top end subpanel 112A and the third bottom end subpanel 112B. The rear right frame surface 516A is defined by the front surface 458A of the second right side subpanel 152A. The outer right frame surface 718A is defined by the front surface 756A of the first right sight subpanel 150A. A first portion of the right frame side 504A overlaps the top frame end 502A, and a second portion of the right frame side 504A overlaps the bottom frame end 502B.

The left frame side 504B defines an inner left frame surface 514B, a rear left frame surface 516B, and an outer left frame surface 618B (shown in FIG. 6). The inner left frame surface 514B is defined by a portion of the front surface 460B of the third left side subpanel 154B positioned substantially between the third top end subpanel 112A and the third bottom end subpanel 112B. The rear left frame surface 516B is defined by the front surface 458B of the second left side subpanel 152B. The outer left frame surface 618B is defined by the front surface 656B of the first left sight subpanel 150B. A first portion of the left frame side 504B overlaps the top frame end 502A, and a second portion of the left frame side 504*b* overlaps the bottom frame end 502B.

In the folded position, top frame end 502A defines the top end locking slots 138A,B which define the right top end locking tab 140A and the left top end locking tab 140B. The bottom frame end 502B defines the bottom end locking slots 138C,D which define the right bottom end locking tab 140C and the left bottom end locking tab 140D. The right frame side 504A defines the right side locking slots 170A,B which define the top right side locking tab 172A and the bottom right side locking tab 172B. The left frame side 504B defines the left side locking slots 170C,D which define the top left side locking tab 172C and the bottom left side locking tab 172D. In the folded position, the right side locking slots 170A,B and the left side locking slots 170C,D are positioned adjacent to the rear working surface 122. The frame sides 504 define the insertion tabs 192, and each of the insertion tabs 192 is inserted into a different one of the end locking slots 138 in the folded position. The insertion tabs 192 are substantially perpendicular to the working panel 106.

In the folded position, the top frame end 502A frictionally engages the top right side locking tab 172A and the top left side locking tab 172C. The bottom frame end 502B frictionally engages the bottom right side locking tab 172B and the bottom left side locking tab 172D. The right frame side 504A frictionally engages the right top end locking tab 140A and the right bottom end locking tab 140C. Specifically, the right top end locking tab 140A and the right bottom end locking tab 140C frictionally engage the inner right frame surface 514A. The left frame side 504B frictionally engages the left top end locking tab 140B and the left bottom end locking tab 140D. Specifically, the left top end locking tab 140B and the left bottom end locking tab 140D frictionally engage the inner left frame surface 514B.

The frame ends 502, side ends 504, and the working panel 106 define a frame cavity 506. Specifically the frame cavity 506 is defined by the inner top frame surface 508A, the inner bottom frame surface 708B, the inner right frame surface 514A, the inner left frame surface 514B, and the rear working surface 122 of the working panel 106. The inner top frame surface 508A, the inner bottom frame surface 708B, the inner right frame surface 514A, and the inner left frame surface 514B are all substantially perpendicular to the rear working surface 122. The inner top frame surface 508A faces and is substantially parallel to the inner bottom frame surface 508B. The inner right frame surface 514A faces and is substantially parallel to the inner left frame surface 514B. The frame cavity 506 has a rectangular shape and a rectangular cross-section when viewed from the top, bottom, front, rear, right, or left; however the shape of the frame cavity 506 should not be viewed as limiting.

FIG. 6 shows a perspective view of a front of the folded canvas 500. The front face 622 of the working panel 106 is shown along with the outer left frame surface 618B of the left frame side 504B and the outer top frame surface 612A of the top end frame 502A. As previously described, the canvas frame 501 comprises the top end frame 502A and the left frame side 504B.

FIG. 7 shows a perspective view of a rear of the folded canvas 500. FIG. 7 shows the end frames 502 and side frames 504 disposed on the rear working surface 122 of the working panel 106. Together, the end frames 502, side frames 504, and the working panel 106 define the frame cavity 506.

FIG. 8 shows the front working surface 622 of the working panel 106 of the folded canvas 500. The top end 178, the bottom end 180, the right side 182, and the left side 184 of the working panel 106 can be seen. In use, a user such as a painter can paint upon the front working surface 622 of the working panel 106. The canvas frame 501 of the folded canvas 500 provides rigidity to the folded canvas 500, thereby eliminating the need for the canvas to be placed upon or supported by a flat surface as would be necessary when painting on a sheet of paper or a portion of other flexible material such as canvas cloth. The rigidity of the folded canvas 500 also allows the folded canvas to be supported by standing the folded canvas 500 on either a frame end 502 or a frame side 504 such as when using an easel without the working panel 106 crumpling or folding from gravity. The front working surface 622 is typically presented such as when the folded canvas 500 is hung on a wall or supported on a stand such as at a gallery.

Figure 9:
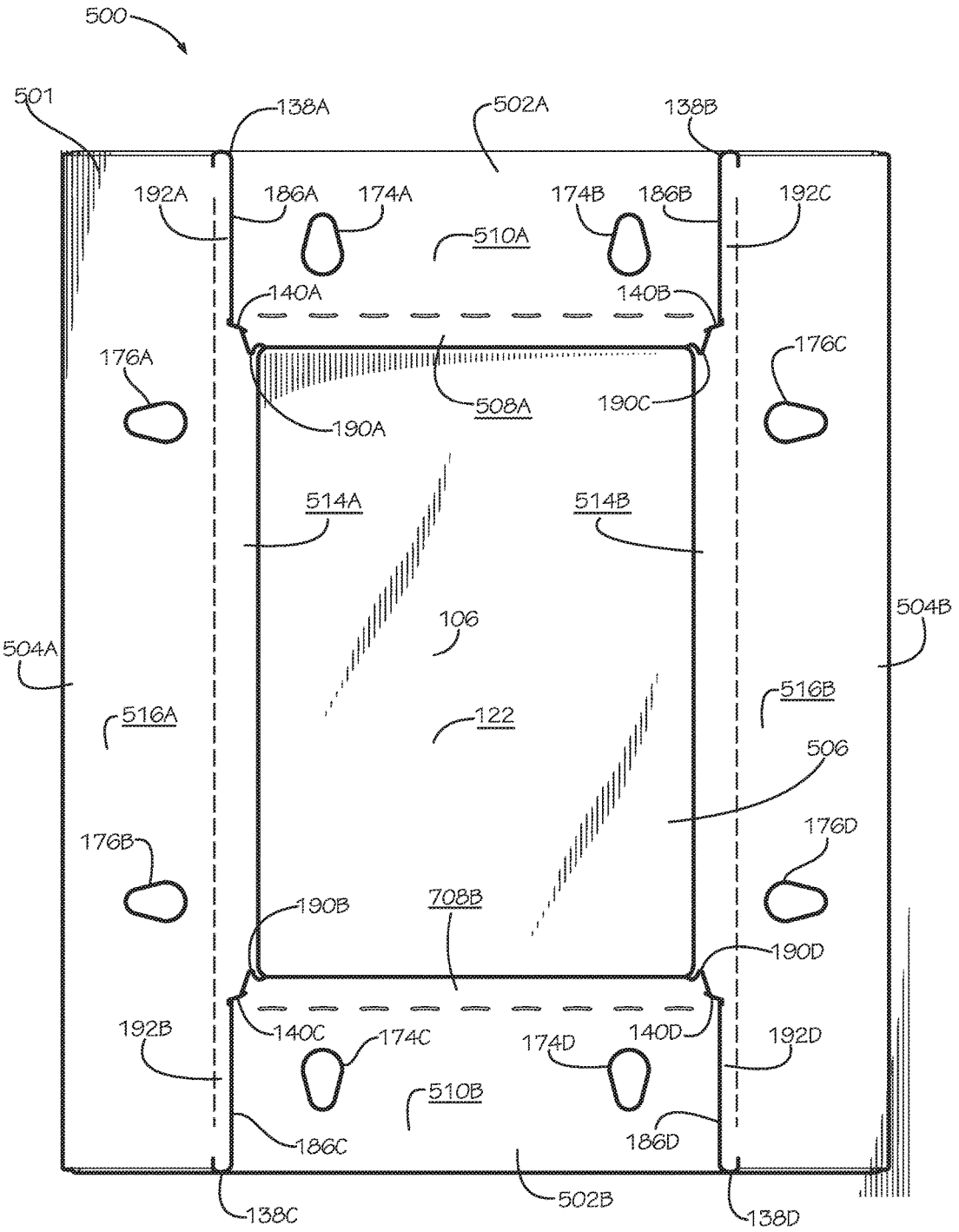
FIG. 9 is a rear view of the folded canvas of FIG. 5.

FIG. 9 shows the rear of the folded canvas 500. As previously described, the canvas frame 501 comprises the top frame end 502A, the bottom frame end 502B, the right frame side 504A, and the left frame side 504B. In the assembled form, the frame ends 502 define the end holes 174, and the frame sides 504 define the side holes 176. In this configuration, end holes 174 and the side holes 176 are oriented so that the end holes 174 and side holes 176 are narrower distal from the working panel 106 and wider proximate the working panel 106. The egg shape of the end holes 174 and the side holes 176 are configured to secure the folded canvas over a fastener head, such as a nail head of a nail driven into a wall, by engaging a rim of the fastener head. The end holes 174 and the side holes 176 allow the folded canvas 500 to be hung as a portrait or a landscape.

Figure 10:
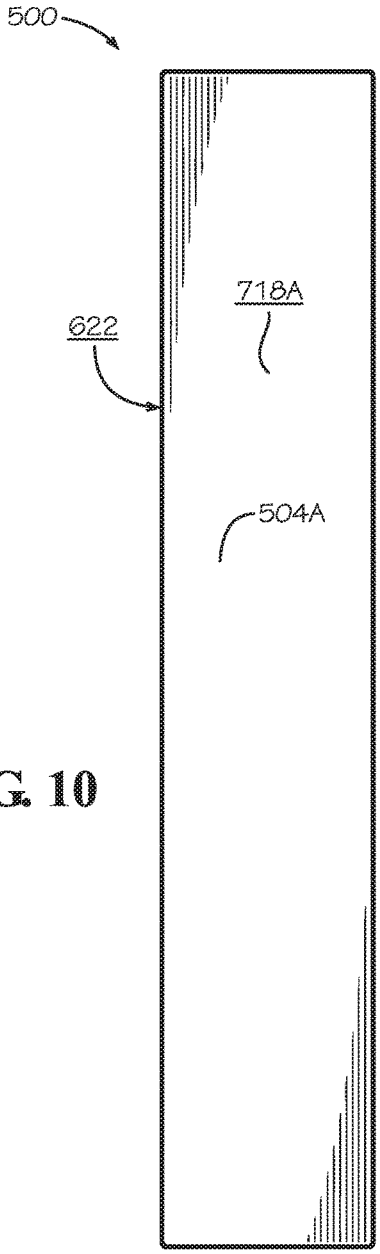
FIG. 10 is a right side view of the folded canvas of FIG. 5.
Figure 11:
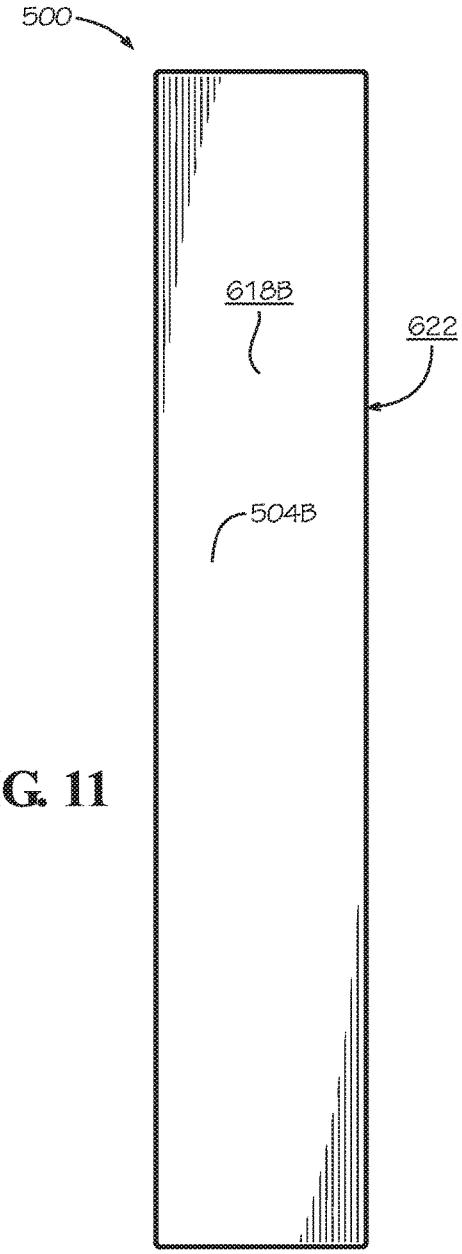
FIG. 11 is a left side view of the folded canvas of FIG. 5.
Figure 12:
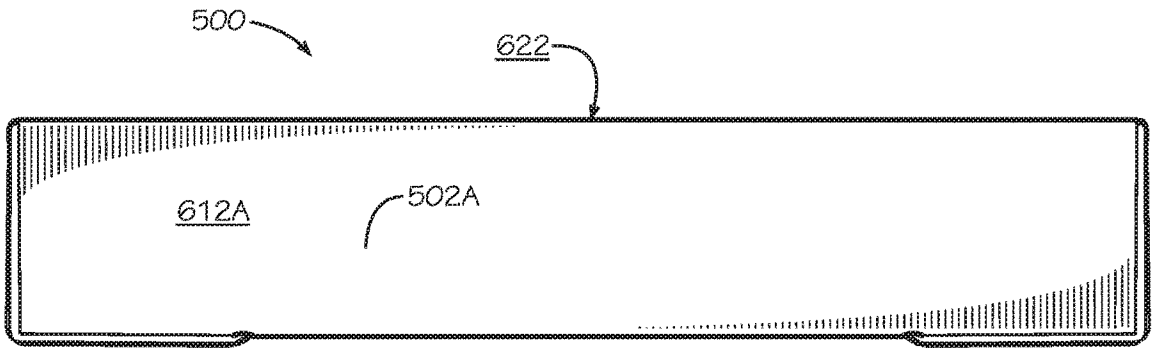
FIG. 12 is a top view of the folded canvas of FIG. 5.
Figure 13:
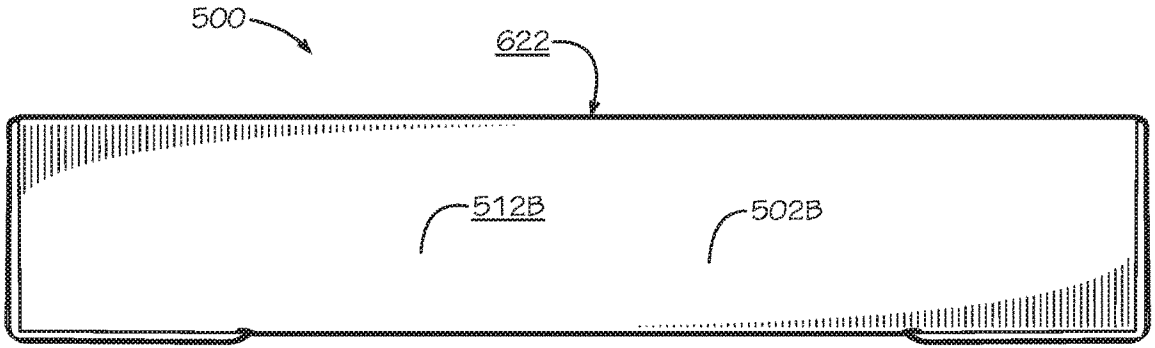
FIG. 13 is a bottom view of the folded canvas of FIG. 5.

FIGS. 10-13 show the ends and the sides of the folded canvas 500. FIG. 10 shows the outer right frame surface 718A of the right frame side 504A. FIG. 11 shows the outer left frame surface 618B of the left frame side 504B. FIG. 12 shows the outer top frame surface 612A of the top frame end 502A. FIG. 13 shows the outer bottom frame surface 512B of the bottom frame end 502B.

The method for assembling the folded canvas 500 can comprise obtaining a foldable canvas blank 100, folding the top end panel 102A and the bottom end panel 102B into an assembled end shape, folding the right side panel 104A and the left side panel 104B into an assembled side shape, frictionally engaging the right side panel 104A with the right top end locking tab 140A and the right bottom end locking tab 140C, and frictionally engaging the left side panel 104B with the left top end locking tab 140B and the bottom end locking tab 140D. The right top end locking tab 140A and the right bottom end locking tab 140C can press against the front face 460A defined by the right side panel 104A. The left top end locking tab 140B and the left bottom end locking tab 140D can press against the front face 460B of the left side panel 104B.

The method can further comprise inserting an insertion tab 192 into a one of the pair of top end locking slots 138A,B and inserting another insertion tab 192 into a one of the pair of bottom end locking slots 138C,D. The method can further comprise frictionally engaging the top end panel 102A with the top right side locking tab 172A and the top left side locking tab 172C, and frictionally engaging the bottom end panel 102B with the bottom right side locking tab 172B and the bottom left side locking tab 172D. The method can further comprise positioning the right side locking slots 170A,B and the left side locking slots 170C,D adjacent to the working panel 106. The method can further comprise folding the top right wing 114A, the top left wing 114B, the bottom right wing 114C, and the bottom left wing 114D towards the working panel 106.

Figure 14:
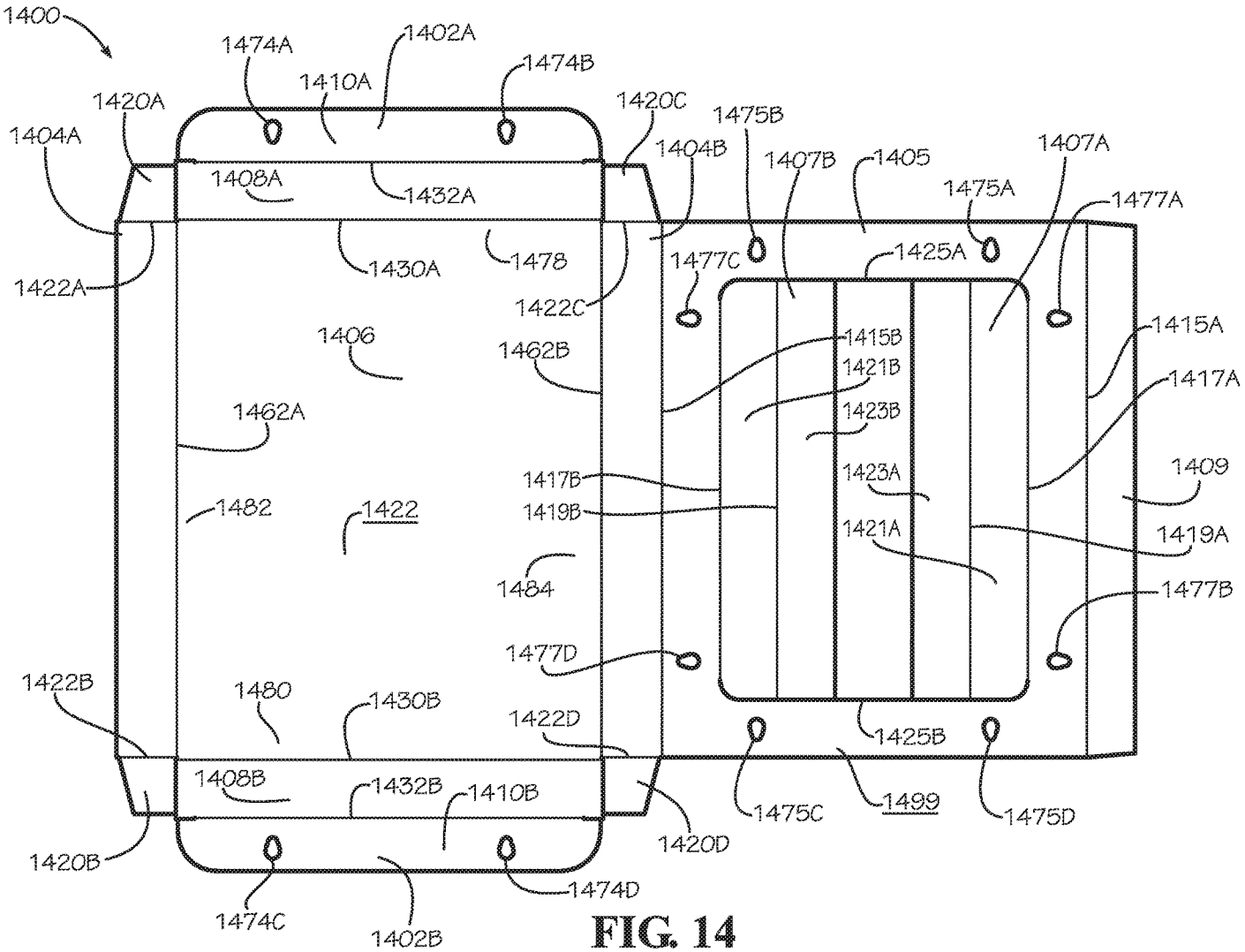
FIG. 14 is a top plan view of another embodiment of a foldable canvas blank.

FIG. 14 is a top view of another embodiment of a foldable canvas blank 1400. The foldable canvas blank 1400 has a working panel 1406 defining a front surface (not shown) and a rear surface 1422. The front surface is positioned opposite from the rear surface 1422. The working panel 1406 comprises a top end 1478, a bottom end 1480, a right side 1482, and a left side 1484. A top end panel 1402A can be flexibly attached to the working panel 1406 at the top end 1478 by a first top end hinge 1430A. A bottom end panel 1402B can be flexibly attached to the bottom end 1480 by a first bottom end hinge 1430B.

As shown in FIG. 14, the top end panel 1402A comprises a first top end subpanel 1408A and a second top end subpanel 1410A. The first top end subpanel 1408A can be flexibly attached to the working panel 1406 at the top end 1478 by the first top end hinge 1430A. The second top end subpanel 1410A can be flexibly attached to the first top end subpanel 1408A by a second top end hinge 1432A positioned opposite from the first top end hinge 1430A. The bottom end panel 1402B comprises a first bottom end subpanel 1408B and a second bottom end subpanel 1410B. The first bottom end subpanel 1408B can be flexibly attached to the working panel 1406 at the bottom end 1480 by the first bottom end hinge 1430B. The second bottom end subpanel 1410B can be flexibly attached to the first bottom end subpanel 1408B by a second bottom end hinge 1432B positioned opposite from the first bottom end hinge 1430B. The second top end subpanel 1402A can define a pair of end holes 1474A,B. The second bottom end subpanel 1402B can define a pair of end holes 1474C,D.

As shown in FIG. 14, a right side panel 1404A can be flexibly attached to the right side 1482 of the working panel 1406 by a first right side hinge 1462A. A top right wing 1420A can be flexibly attached to the right side panel 1404A by a top right wing hinge 1422A. A bottom right wing 1420B can be flexibly attached to the right side panel 1404A by a bottom right wing hinge 1422B. A left side panel 1404B can be flexibly attached to the left side 1482 of the working panel 1406 by a first left side hinge 1462B. A top left wing 1420C can be flexibly attached to the left side panel 1404B by a top left wing hinge 1422C. A bottom left wing 1420D can be flexibly attached to the left side panel 1404B by a bottom left wing hinge 1422D.

As shown in FIG. 14, a frame panel 1405 can be flexibly attached to one of the right side panel 1404A and the left side panel 1404B. In the embodiment shown, the frame panel 1405 is flexibly attached to the left side panel 1404B by a left frame hinge 1415B. A frame flap 1409 is flexibly attached to the frame panel 1405 by a right frame hinge 1415A. The frame flap 1409 is configured to be attached to the opposite side panel 1404. In this embodiment, the frame flap 1409 is configured to be adhered to the right side panel 1404A.

The frame panel 1405 defines an inner surface 1499 and an outer surface 1599 (shown in FIG. 15) positioned opposite from the inner surface 1499. The frame panel 1405 defines a pair of top end frame holes 1475A,B, a pair of bottom end frame holes 1475C,D, a pair of right side frame holes 1477A,B, and a pair of left side frame holes 1477C,D. Each pair of frame holes extends from the inner surface 1499 to the outer surface 1599. The frame panel 1405 comprises a right inner flap 1407A flexibly attached to the frame panel 1405 by a first right inner hinge 1417A. The frame panel also comprises a left inner flap 1407B flexibly attached to the frame panel 1405 by a first left inner hinge 1417B. The right inner flap 1407A and the left inner flap 1407B are partially defined by a top frame cutout 1425A and a bottom frame cutout 1425B, each extending from the inner surface 1499 to the outer surface 1599.

The right inner flap 1407A comprises a first right inner subpanel 1421A flexibly attached to the frame panel by the first right inner hinge 1417A and a second right inner subpanel 1423A flexibly attached to the first right inner subpanel 1421A by a second right inner hinge 1419A. The second right inner hinge 1419A is positioned on the first right inner subpanel 1421A opposite from the first right inner hinge 1417A. The left inner flap 1407B comprises a first left inner subpanel 1421B flexibly attached to the frame panel by the first left inner hinge 1417B and a second left inner subpanel 1423B flexibly attached to the first left inner subpanel 1421B by a second left inner hinge 1419B. The second left inner hinge 1419B is positioned on the first left inner subpanel 1421B opposite from the first left inner hinge 1417B.

The foldable canvas blank 1400 can be assembled to form a folded canvas 1500 (shown in FIG. 15) when the foldable canvas blank 1400 is folded into a folded position. In the embodiment shown, the foldable canvas blank 1400 requires an attachment step, such as gluing or otherwise securing, affixing the frame flap 1409 to the right side panel 1404A. Unlike the folded canvas 1500 embodiment, the folded canvas 500 embodiment can be assembled from the foldable canvas blank 100 embodiment without the need for glues, adhesives, or other securing measures, unless optionally desired.

Figure 15:
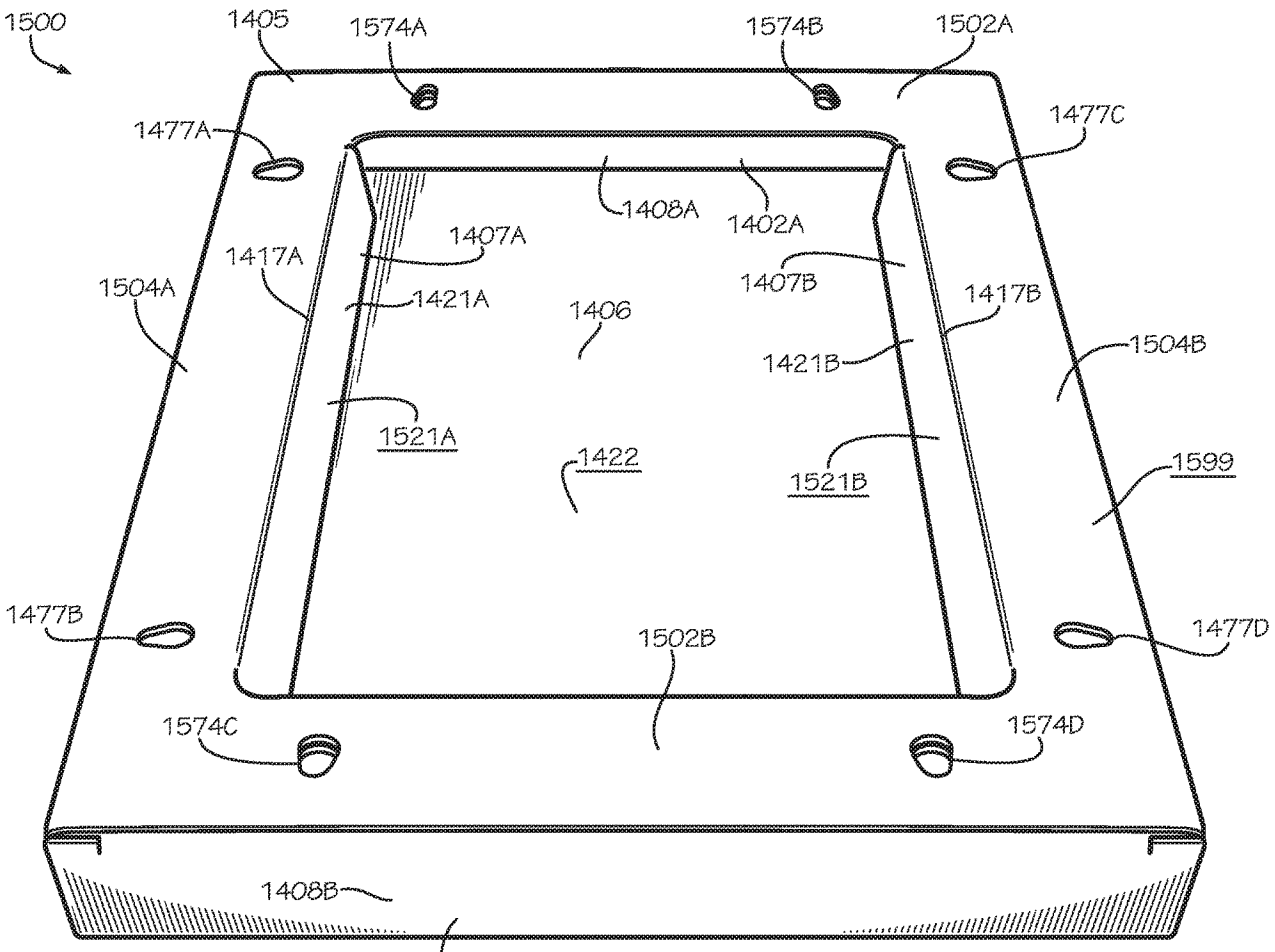
FIG. 15 is a rear perspective view of a folded canvas assembled from the foldable canvas blank of FIG. 14.

FIG. 15 shows a perspective view of a rear of the folded canvas 1500 assembled from the foldable canvas blank 1400 of FIG. 14. To form the folded canvas 1500, the frame flap 1409 is first secured to the right side panel 1404A. When viewed from the top or bottom, this configuration produces a parallelogram-shaped cross-section. The foldable canvas blank 1400 can then be opened by translating the frame panel 1405 relative to the working panel 1406 to produce a rectangular-shaped cross-section when viewed from the top or bottom. In this configuration, the right side panel 1404A, the left side panel 1404B, and the frame flap 1409 are substantially perpendicular to the working panel 1406, and the frame panel 1405 is substantially parallel to the working panel 1406.

Next, the top right wing 1420A and the top left wing 1420C can be folded about the top right wing hinge 1422A and the top left wing hinge 1422C, respectively, towards the working panel 1406 until the top right wing 1420A and the top left wing 1420C are substantially aligned with the first top end hinge 1430A. The top end panel 1402A can then be folded about the first top end hinge 1430A and the second top end hinge 1432A in order to insert the second top end subpanel 1410A between the working panel 1406 and the frame panel 1405. In this position, the first top end subpanel 1408A is substantially perpendicular to the working panel 1406, and the second top end subpanel 1410A is positioned in facing contact with the inner surface 1499 of the frame panel 1405. In this position, the top pair of end holes 1474A,B align with the top end frame holes 1475A,B, respectively, to form a pair of top canvas holes 1574A,B. Completing this step forms a top frame end 1502A.

Next, the bottom right wing 1420B and the bottom left wing 1420D can be folded about the bottom right wing hinge 1422B and the bottom left wing hinge 1422D, respectively, towards the working panel 1406 until the bottom right wing 1420B and the bottom left wing 1420D are substantially aligned with the first bottom end hinge 1430B. The bottom end panel 1402B can then be folded about the first bottom end hinge 1430B and the second bottom end hinge 1432B in order to insert the second bottom end subpanel 1410B between the working panel 1406 and the frame panel 1405. In this position, the first bottom end subpanel 1408B is substantially perpendicular to the working panel 1406, and the second bottom end subpanel 1410B is positioned in facing contact with the inner surface 1499 of the frame panel 1405, substantially parallel to both the working panel 1406 and the frame panel 1405. In this position, the bottom pair of end holes 1474C,D align with the bottom end frame holes 1475C,D, respectively, to form a pair of bottom canvas holes 1574C,D. Completing this step forms a bottom frame end 1502B.

To form a right frame side 1504A and a left frame side 1504B, the right inner flap 1407A and the left inner flap 1407B are folded towards the working panel 1406. The right inner flap 1407A can be folded about the first right inner hinge 1417A and the second right inner hinge 1419A to position the second right inner subpanel 1423A in facing contact and substantially parallel to the rear surface 1422 of the working panel 1406. In this position, the first right inner subpanel 1421A is substantially perpendicular to the working panel 1406. The left inner flap 1407B can be folded about the first left inner hinge 1417B and the second left inner hinge 1419B to position the second left inner subpanel 1423B in facing contact and substantially parallel to the rear surface 1422 of the working panel 1406. In this position, the first left inner subpanel 1421B is substantially perpendicular to the working panel 1406. Upon completion of these steps, the right frame side 1504A and the left frame side 1504B have been formed, and the folded canvas 1500 has been assembled.

In use, a user can paint on the front surface of the working panel 1406 of the folded canvas 1500. Upon completing the work, the folded canvas 1500 can be hung from a nail by engaging the nailhead with either the canvas holes 1574A, B,C,D or the side frame holes 1477A,B,C,D.

The foldable canvas blanks 100, 1400 can be comprised of cardboard. The material should not be view as limiting, and the foldable canvas blanks 100,1400 can be comprised of other materials such as metal, paper, plastic, or any other material. The hinges 130A,B, 132A,B, 134A,B, 136A,B,C, D, 162A,B, 164A,B, 166A,B, 1430A,B, 1432A,B, 1462A, B, 1422A,B,C,D, 1415A,B, 1417A,B, and 1419A,B can be living hinges and may be scored or perforated to bias for controlled bending of the foldable canvas blanks 100, 1400. The foldable canvas blanks 100,1400 can be colored white to provide a neutral painting surface; however, in some embodiments, the foldable canvas blanks 100,1400 can have other colors such as brown or black. In some embodiments, different surfaces of the foldable canvas blanks 100,1400 can differ in color, such as some surfaces being colored white and other surfaces being brown as is common of raw cardboard material.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the present disclosure, nor the claims which follow.

That which is claimed is:

1. A foldable canvas blank comprising:

a working panel, the working panel comprising a top end, a bottom end, a right side, and a left side, the top disposed opposite from the bottom, the left side disposed opposite from the right side;

a top end panel flexibly attached to the top end by a first top end hinge, the top end panel defining a front surface and a rear surface, the top end panel defining a pair of top end locking slots extending from the front surface to the rear surface, the pair of top end locking slots defining a right top end locking tab and a left top end locking tab;

a bottom end panel flexibly attached to the bottom end by a first bottom end hinge, the bottom end panel defining a front surface and a rear surface, the bottom end panel defining a pair of bottom end locking slots extending from the front surface to the rear surface, the pair of bottom end locking slots defining a right bottom end locking tab and a left bottom end locking tab;

a right side panel flexibly attached to the right side by a first right side hinge, the right side panel configured to frictionally engage the right top end locking tab and the right bottom end locking tab in a folded position; and a left side panel flexibly attached to the left side by a first left side hinge, the left side panel configured to frictionally engage the left top end locking tab and the left bottom end locking tab in the folded position; and wherein each of the end locking slots comprises a curved portion, each of the end locking tabs is defined by a different one of the curved portions.

2. The foldable canvas blank of claim 1, wherein the right side panel defines a front surface and a rear surface, the right side panel defines a pair of right side locking slots extending from the front surface to the rear surface, the pair of right side locking slots defines a top right side locking tab and a bottom right side locking tab, the left side panel defines a front surface and a rear surface, the left side panel defines a pair of left side locking slots extending from the front surface to the rear surface, the pair of left side locking slots defines a top left side locking tab and a bottom left side locking tab, the top left side locking tab and the top right side locking tab are configured to frictionally engage the top end panel in the folded position, and the bottom left side locking tab and the bottom right side locking tab are configured to frictionally engage the bottom end panel in the folded position.

3. The foldable canvas blank of claim 2, wherein the right side panel defines a right side edge surface distal from the working panel, each of the pair of right side locking slots intersects the right side edge surface, the left side panel defines a left side edge surface distal from the working panel, and each of the pair of left side locking slots intersects the left side edge surface.

4. The foldable canvas blank of claim 1, wherein the top end panel defines a top end edge surface distal from the working panel, each of the pair of top end locking slots disposed separate from the top end edge surface, the bottom end panel defines a bottom end edge surface distal from the working panel, and each of the pair of bottom end locking slots disposed separate from the bottom end edge surface.

5. The foldable canvas blank of claim 1, wherein each of the end locking slots comprises a straight portion, each of the side panels defines a pair of insertion tabs, and each of the straight portions is configured to receive a different one of the insertion tabs.

6. The foldable canvas blank of claim 1, wherein the top end panel comprises a first top end subpanel, a second top end subpanel, and a third top end subpanel, the first top end subpanel is connected to the working panel by the first top end hinge, the second top end subpanel is connected to the first top end subpanel by a second top end hinge positioned opposite from the first top end hinge, the third top end subpanel is connected to the second top end subpanel by a third top end hinge positioned opposite from the second top end hinge, and the top end locking tabs are defined by the third top end subpanel of the top end panel.

7. A folded canvas comprising:

a working panel, the working panel defining a front working surface and a rear working surface, the working panel comprising a top end, a bottom end, a right side, and a left side, the top disposed opposite from the bottom, the left side disposed opposite from the right side;

a top frame end disposed on the rear working surface at the top end of the working panel, the top frame end defining a pair of top end locking slots, the pair of top end locking slots defining a right top end locking tab and a left top end locking tab;

a bottom frame end disposed on the rear working surface at the bottom end of the working panel, the bottom frame end defining a pair of bottom end locking slots, the pair of bottom end locking slots defining a right bottom end locking tab and a left bottom end locking tab;

a right frame side disposed on the rear working surface at the right side of the working panel, the right frame side frictionally engaging the right top end locking tab and the left top end locking tab; and a left frame side disposed on the rear working surface at the left side of the working panel, the left frame side frictionally engaging the left top end locking tab and the left bottom end locking tab; and wherein the right side locking slots are positioned adjacent to the working panel.

8. The folded canvas of claim 7, wherein the right frame side defines an inner right frame surface substantially perpendicular to the rear working surface, the left frame side defines an inner left frame surface substantially perpendicular to the rear working surface, the inner right frame surface is substantially parallel to the inner left frame surface, the inner right frame surface faces the inner left frame surface, the right top end locking tab and the right bottom end locking tab frictionally engage the inner right frame surface, and the left top end locking tab and the left bottom end locking tab frictionally engage the inner left frame surface.

9. The folded canvas of claim 7, wherein each of the frame sides comprises a pair of insertion tabs, each of the insertion tabs inserted into a different one of the end locking slots.

10. The folded canvas of claim 9, wherein the insertion tabs are substantially perpendicular to the working panel.

11. The folded canvas of claim 7, wherein the right frame side defines a pair of right frame locking slots, the right side locking slots define a top right side locking tab and a bottom right side locking tab, the top right side locking tab frictionally engages the top end frame, and the bottom right side locking tab frictionally engages the bottom end frame.

12. The folded canvas of claim 7, wherein a first portion of the right frame side overlaps a portion of the top end frame and a second portion of the right frame side overlaps a portion of the bottom end frame.

13. A method for assembling a folded canvas comprising:

obtaining a foldable canvas blank, the foldable canvas blank comprising:

a working panel, the working panel comprising a top end, a bottom end, a right side, and a left side, the top disposed opposite from the bottom, the left side disposed opposite from the right side;

a top end panel flexibly attached to the top end, the top end panel defining a pair of top end locking slots, the pair of top end locking slots defining a right top end locking tab and a left top end locking tab;

a bottom end panel flexibly attached to the bottom end, the bottom end panel defining a pair of bottom end locking, the pair of bottom end locking slots defining a right bottom end locking tab and a left bottom end locking tab;

a right side panel flexibly attached to the right side; and a left side panel flexibly attached to the left side;

folding the top end panel and the bottom end panel into an assembled end shape;

folding the right side panel and the left side panel into an assembled side shape;

frictionally engaging the right side panel with the right top end locking tab and the right bottom end locking tab;

frictionally engaging the left side panel with the left top end locking tab and the left bottom end locking tab; and positioning the right side locking slots adjacent to the working panel.

14. The method of claim 13, further comprising:

inserting an insertion tab defined by the right side panel into a one of the pair of top end locking slots.

15. The method of claim 13, wherein the right side panel defines a pair of right side locking slots, the right side locking slots define a top right side locking tab and a bottom right side locking tab, and the method further comprises:

frictionally engaging the top end panel with the top right side locking tab; and frictionally engaging the bottom end panel with the bottom right side locking tab.

16. The method of claim 13, wherein the top end panel comprises a top left wing and a top right wing, the method further comprising:

folding the top left wing and the top right wing towards the working panel.

17. The method of claim 13, wherein the right top end locking tab and the right bottom end locking tab press against a front face defined by the right side panel.

18. A foldable canvas blank comprising:

a working panel, the working panel comprising a top end, a bottom end, a right side, and a left side, the top disposed opposite from the bottom, the left side disposed opposite from the right side;

a top end panel flexibly attached to the top end by a first top end hinge, the top end panel defining a front surface and a rear surface, the top end panel defining a pair of top end locking slots extending from the front surface to the rear surface, the pair of top end locking slots defining a right top end locking tab and a left top end locking tab;

a bottom end panel flexibly attached to the bottom end by a first bottom end hinge, the bottom end panel defining a front surface and a rear surface, the bottom end panel defining a pair of bottom end locking slots extending from the front surface to the rear surface, the pair of bottom end locking slots defining a right bottom end locking tab and a left bottom end locking tab;

a right side panel flexibly attached to the right side by a first right side hinge, the right side panel configured to frictionally engage the right top end locking tab and the right bottom end locking tab in a folded position; and a left side panel flexibly attached to the left side by a first left side hinge, the left side panel configured to frictionally engage the left top end locking tab and the left bottom end locking tab in the folded position; and wherein the right side panel defines a front surface and a rear surface, the right side panel defines a pair of right side locking slots extending from the front surface to the rear surface, the pair of right side locking slots defines a top right side locking tab and a bottom right side locking tab, the left side panel defines a front surface and a rear surface, the left side panel defines a pair of left side locking slots extending from the front surface to the rear surface, the pair of left side locking slots defines a top left side locking tab and a bottom left side locking tab, the top left side locking tab and the top right side locking tab are configured to frictionally engage the top end panel in the folded position, and the bottom left side locking tab and the bottom right side locking tab are configured to frictionally engage the bottom end panel in the folded position; and wherein the right side panel defines a right side edge surface distal from the working panel, each of the pair of right side locking slots intersects the right side edge surface, the left side panel defines a left side edge surface distal from the working panel, and each of the pair of left side locking slots intersects the left side edge surface.

19. A foldable canvas blank comprising:

a working panel, the working panel comprising a top end, a bottom end, a right side, and a left side, the top disposed opposite from the bottom, the left side disposed opposite from the right side;

a top end panel flexibly attached to the top end by a first top end hinge, the top end panel defining a front surface and a rear surface, the top end panel defining a pair of top end locking slots extending from the front surface to the rear surface, the pair of top end locking slots defining a right top end locking tab and a left top end locking tab;

a bottom end panel flexibly attached to the bottom end by a first bottom end hinge, the bottom end panel defining a front surface and a rear surface, the bottom end panel defining a pair of bottom end locking slots extending from the front surface to the rear surface, the pair of bottom end locking slots defining a right bottom end locking tab and a left bottom end locking tab;

a right side panel flexibly attached to the right side by a first right side hinge, the right side panel configured to frictionally engage the right top end locking tab and the right bottom end locking tab in a folded position; and a left side panel flexibly attached to the left side by a first left side hinge, the left side panel configured to frictionally engage the left top end locking tab and the left bottom end locking tab in the folded position; and wherein the top end panel comprises a first top end subpanel, a second top end subpanel, and a third top end subpanel, the first top end subpanel is connected to the working panel by the first top end hinge, the second top end subpanel is connected to the first top end subpanel by a second top end hinge positioned opposite from the first top end hinge, the third top end subpanel is connected to the second top end subpanel by a third top end hinge positioned opposite from the second top end hinge, and the top end locking tabs are defined by the third top end subpanel of the top end panel.

20. A folded canvas comprising:

a working panel, the working panel defining a front working surface and a rear working surface, the working panel comprising a top end, a bottom end, a right side, and a left side, the top disposed opposite from the bottom, the left side disposed opposite from the right side;

a top frame end disposed on the rear working surface at the top end of the working panel, the top frame end defining a pair of top end locking slots, the pair of top end locking slots defining a right top end locking tab and a left top end locking tab;

a bottom frame end disposed on the rear working surface at the bottom end of the working panel, the bottom frame end defining a pair of bottom end locking slots, the pair of bottom end locking slots defining a right bottom end locking tab and a left bottom end locking tab;

a right frame side disposed on the rear working surface at the right side of the working panel, the right frame side frictionally engaging the right top end locking tab and the left top end locking tab; and a left frame side disposed on the rear working surface at the left side of the working panel, the left frame side frictionally engaging the left top end locking tab and the left bottom end locking tab; and wherein the right frame side defines an inner right frame surface substantially perpendicular to the rear working surface, the left frame side defines an inner left frame surface substantially perpendicular to the rear working surface, the inner right frame surface is substantially parallel to the inner left frame surface, the inner right frame surface faces the inner left frame surface, the right top end locking tab and the right bottom end locking tab frictionally engage the inner right frame surface, and the left top end locking tab and the left bottom end locking tab frictionally engage the inner left frame surface.

* * * * *